US005798471A

United States Patent [19]

Miller

[11] Patent Number: 5,798,471

[45] Date of Patent: Aug. 25, 1998

[54] ROTARY VALVE FOR MUSICAL INSTRUMENTS

[76] Inventor: Robert M. Miller, 406 Meyer Ave., St. Louis, Mo. 63122

[21] Appl. No.: 854,189

[22] Filed: May 9, 1997

Related U.S. Application Data

[63] Continuation-in-part of Ser. No. 552,605, Nov. 3, 1995, abandoned.

[51] Int. Cl.[6] ..... G10D 9/04

[52] U.S. Cl. ..... 84/390; 84/395

[58] Field of Search ..... 84/390, 388, 389, 84/393, 395

[56] References Cited

U.S. PATENT DOCUMENTS

| | | | |
|---|---|---|---|
| 3,554,072 | 1/1971 | Hirsbrunner | 87/390 |
| 4,469,002 | 9/1984 | Thayer . | |
| 5,396,825 | 3/1995 | Kirts | 84/390 |

*Primary Examiner*—Michael L. Gellner
*Assistant Examiner*—Shih-yung Hsieh
*Attorney, Agent, or Firm*—Robbins & Robbins

[57] ABSTRACT

A rotary valve for musical instruments is provided. The valve is specially designed to have three internal passages with gentle curves and continuously circular passageways to provide true tonal qualities and a minimum of distortion. The valve passages have a bend radius of at least the diameter of the valve passage and the casing of the valve approximates three times the diameter of the passages. The valve passages to and from the loop are positioned on opposite sides of and cross over a through passage from the mouthpiece to the bell for economy of space and gentle passage curvature. The inlet and outlet openings or end holes in the loop engaging passages are located approximately 45° from one another along their axes to avoid substantial changes in the direction of air flow. The 45° angle is between diameters of the openings and can also be expressed as 135° around the circumference of the rotor. Continuous flow during valve operation is provided in a modification. In this modification the bend radius is approximately one-half the passage diameter and the casing of the valve approximates two and one-half the passage diameter. Multiple valves for multiple loops are provided by rotating each subsequent valve 180°. Valves with the internal and external short loops are also described.

28 Claims, 27 Drawing Sheets

ROTARY VALVE FOR MUSICAL INSTRUMENTS

RELATED APPLICATION

This application is a continuation-in-part of my earlier filed application Ser. No. 08/552,605, filed Nov. 3, 1995, now abandoned.

BACKGROUND OF THE INVENTION

The air column in a traditional rotary valve is characterized by an abrupt and substantial change in direction due to small radius tube bends of more than 90° and pathways of varying size and shape in which sharp edges intrude. These characteristics cause a change in impedance or resistance to flow as the soundwave travels through the valve. This in turn causes soundwave reflections at the valve which causes some distortion in the sound of the instrument.

The air column in a traditional piston valve is also characterized by an abrupt and substantial change in directions, due also to small radius tube bends of more than 90°. This again causes a change in impedance as the soundwave passes through the piston valve.

SUMMARY OF THE INVENTION

A rotary valve for selectively adding and removing a loop of tubing from the air path of a brass musical instrument is provided by this invention. The valve consists of a hollow outer cylinder (casing) and a hollow inner cylinder (rotor) in which three walled tubes are affixed. The external tubing forming the original or shortest air pathway of the instrument as well as the loop of tubing which, when engaged, increases the overall length of the air pathway are attached to the outer cylinder at positions where holes of the same size are drilled into the casing. The hollow rotor contains three hollow tubes which direct the air either through the original pathway, or, when rotated 90°, direct the air away from the original pathway, into the tubing loop, out of the tubing loop and back to the original pathway. These internal tubes are attached at positions where holes are drilled in the rotor walls. As the tubes travel across the axis of the rotor, they bend to avoid each other. Each tube bend inside the rotor in one embodiment has a radius equal to or greater than a tube outside diameter while in another embodiment the radius of each tube bend is equal or greater than one-half a tube outside diameter. The designed tube pathway also provides for minimal angular deviation from the original direction of airflow. At the point where each tube inside the rotor meets its concomitant loop tube or original pathway tube, both tubes have the same axis which is a radius of the concentric axes of both the rotor and casing cylinders. The result is a smaller change in impedance as the soundwave travels through the valve when compared with traditional rotary and piston valves which in turn results in less distortion in the sound of the instrument. This valve is also designed so that it can be easily grouped in multi-valve arrays. A short loop variant is included in the design for those applications in which the half-step valve allows a loop shorter than possible on the regular loop application.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

Figure 14:
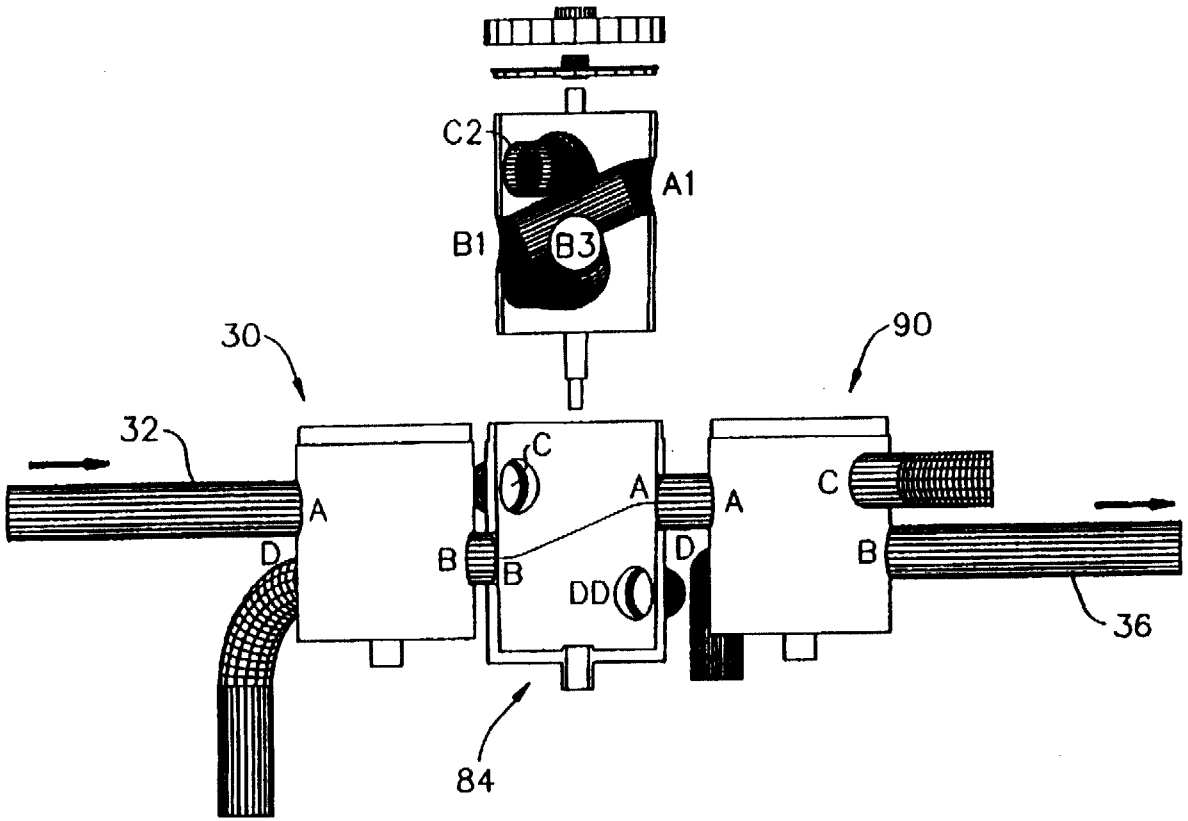
FIG. 14 is an exploded top plan view of an intermediate short loop valve with two regular valves with internal passages of the short loop valve.
Figure 15:
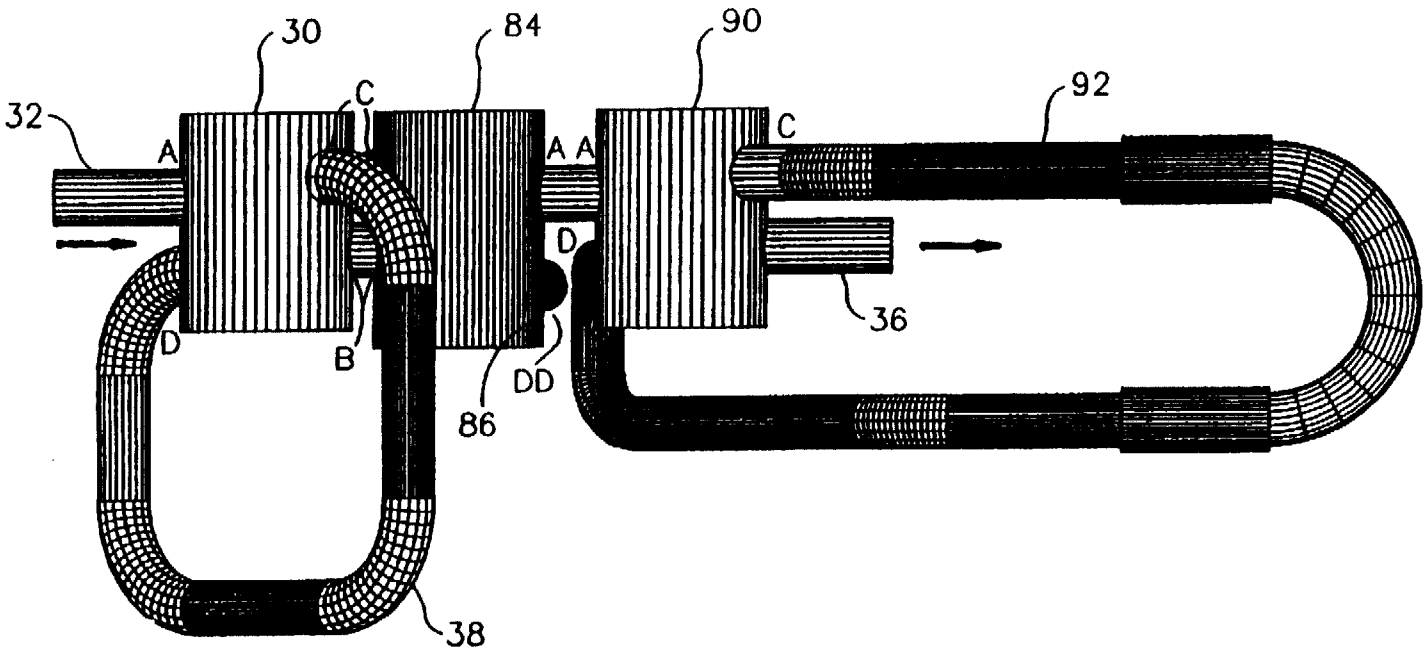
FIG. 15 is an enlarged top plan view of the valve and loop combination of FIG. 14.
Figure 16:
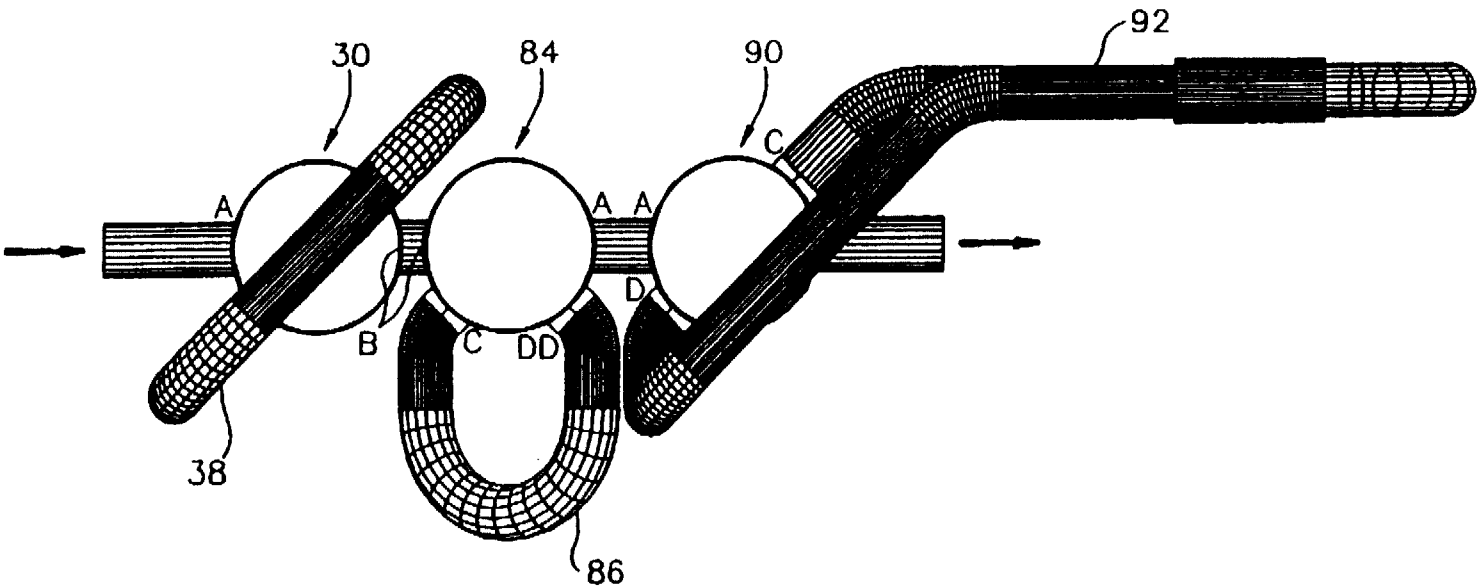
Figure 17:
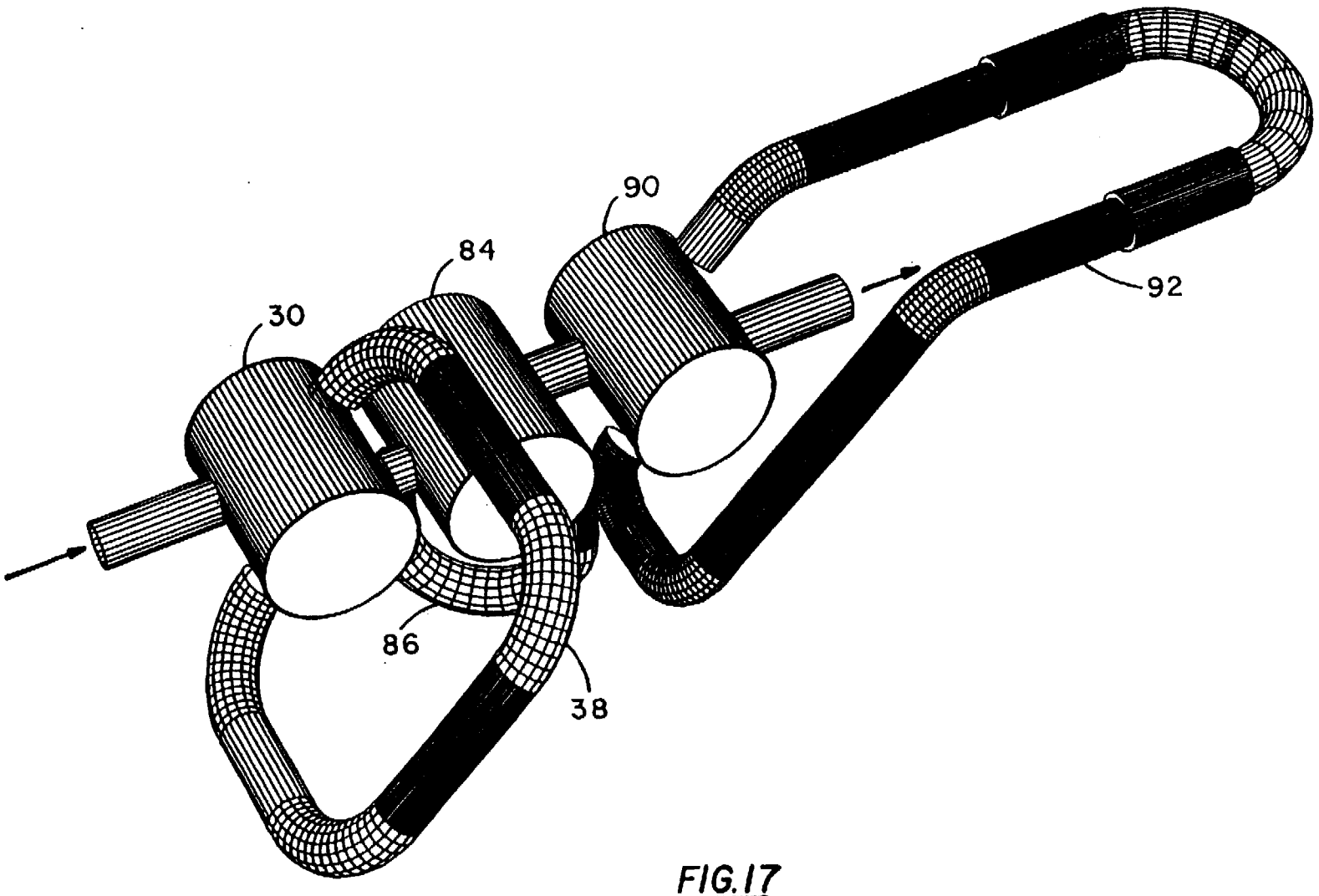
Figure 18:
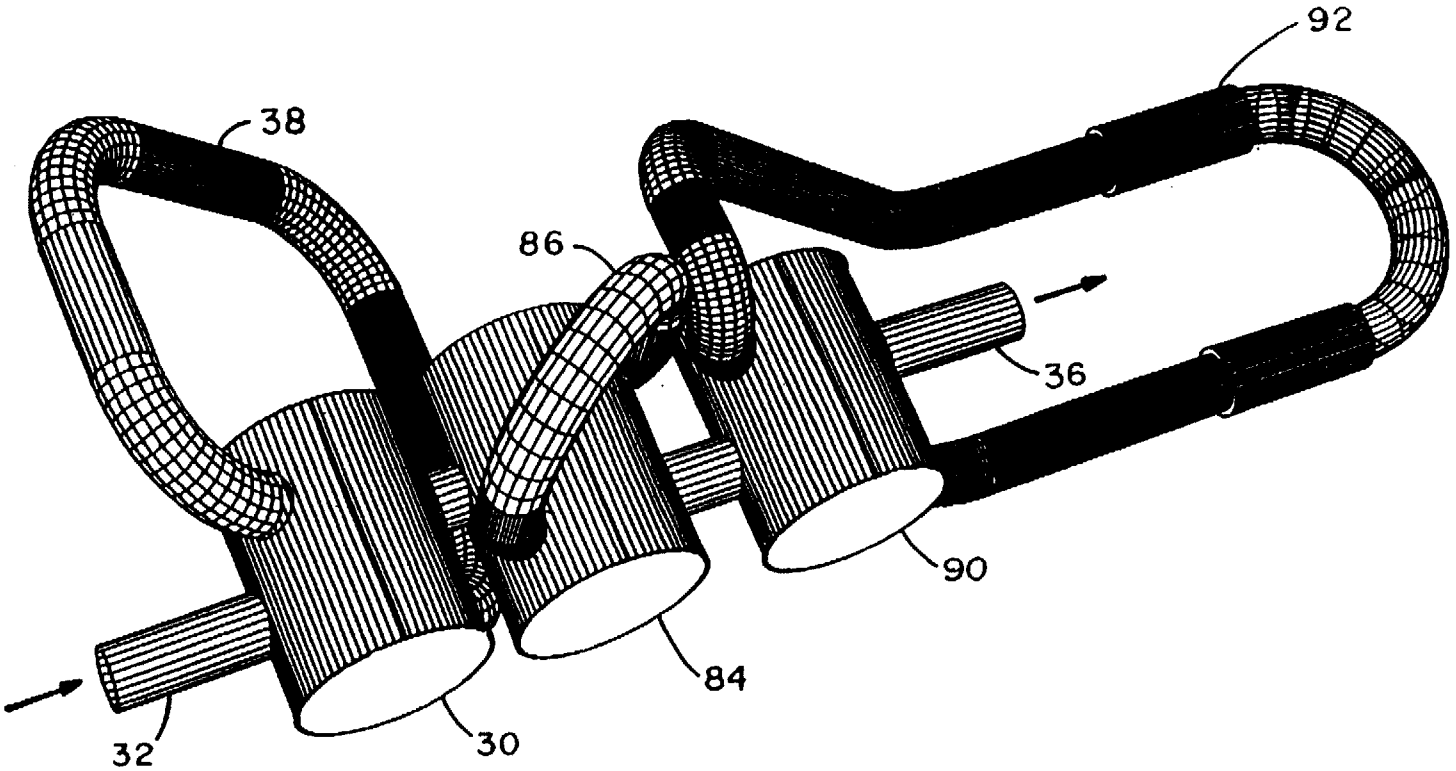
Figure 19:
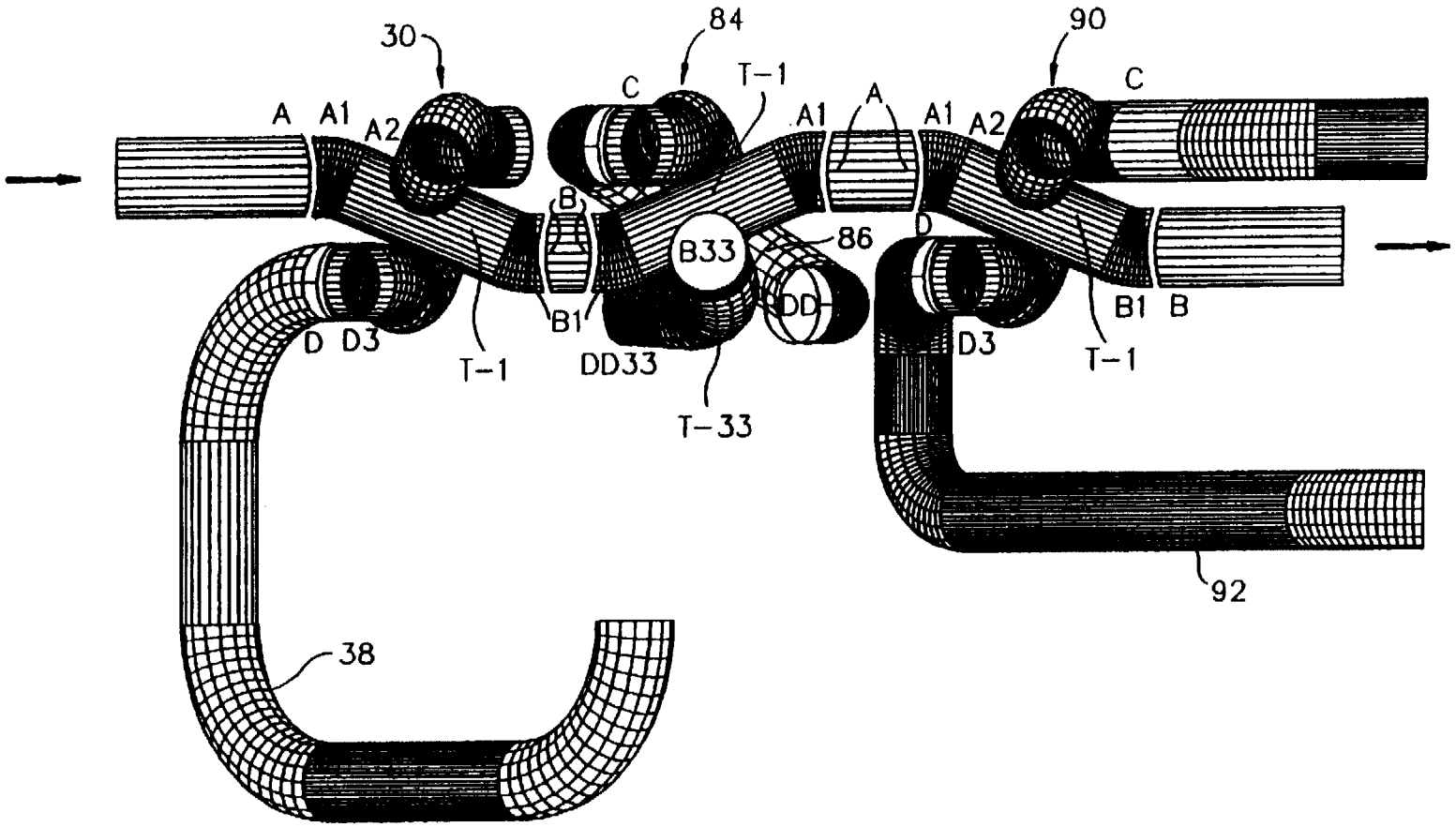
Figure 20:
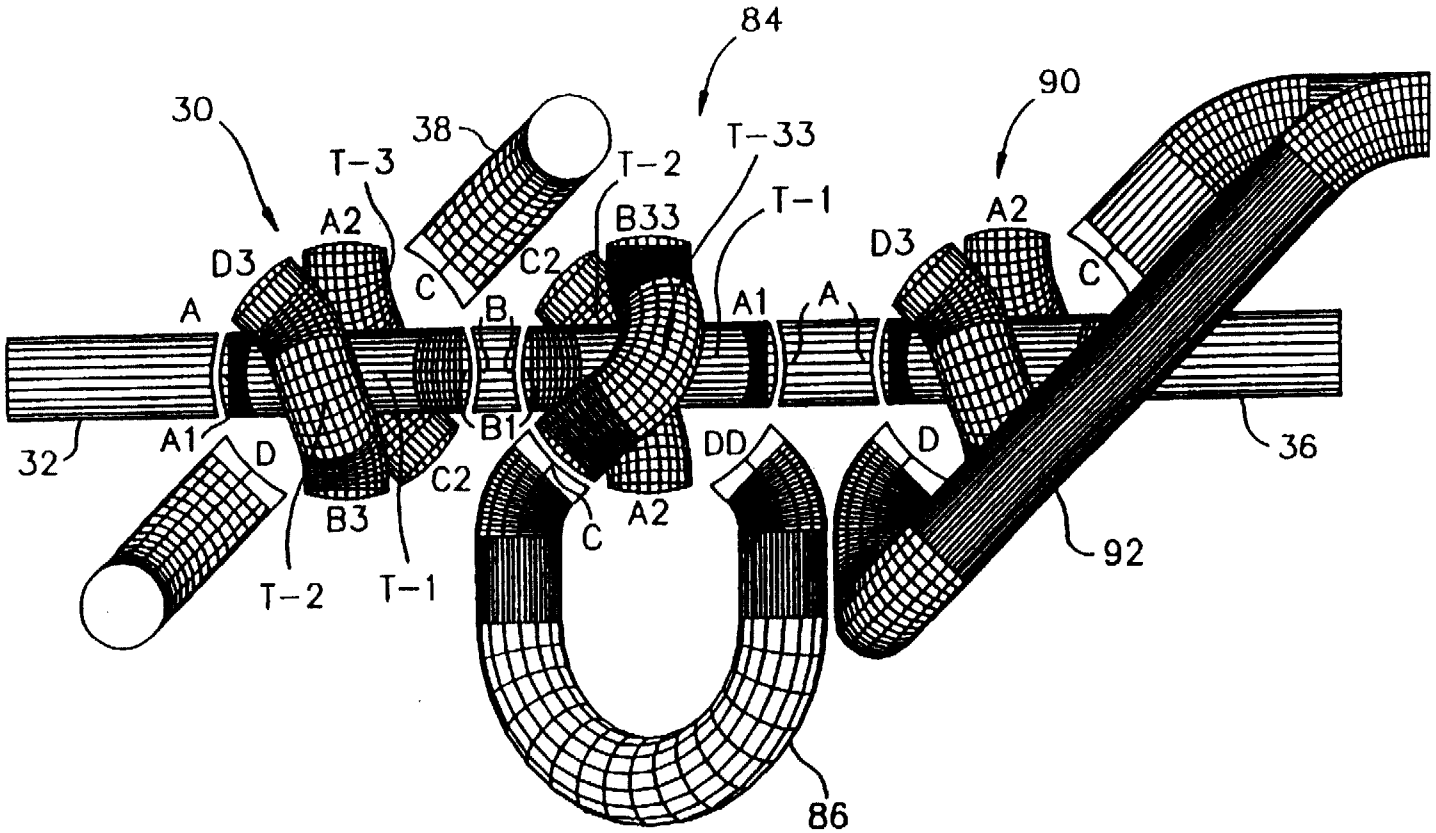
Figure 21:
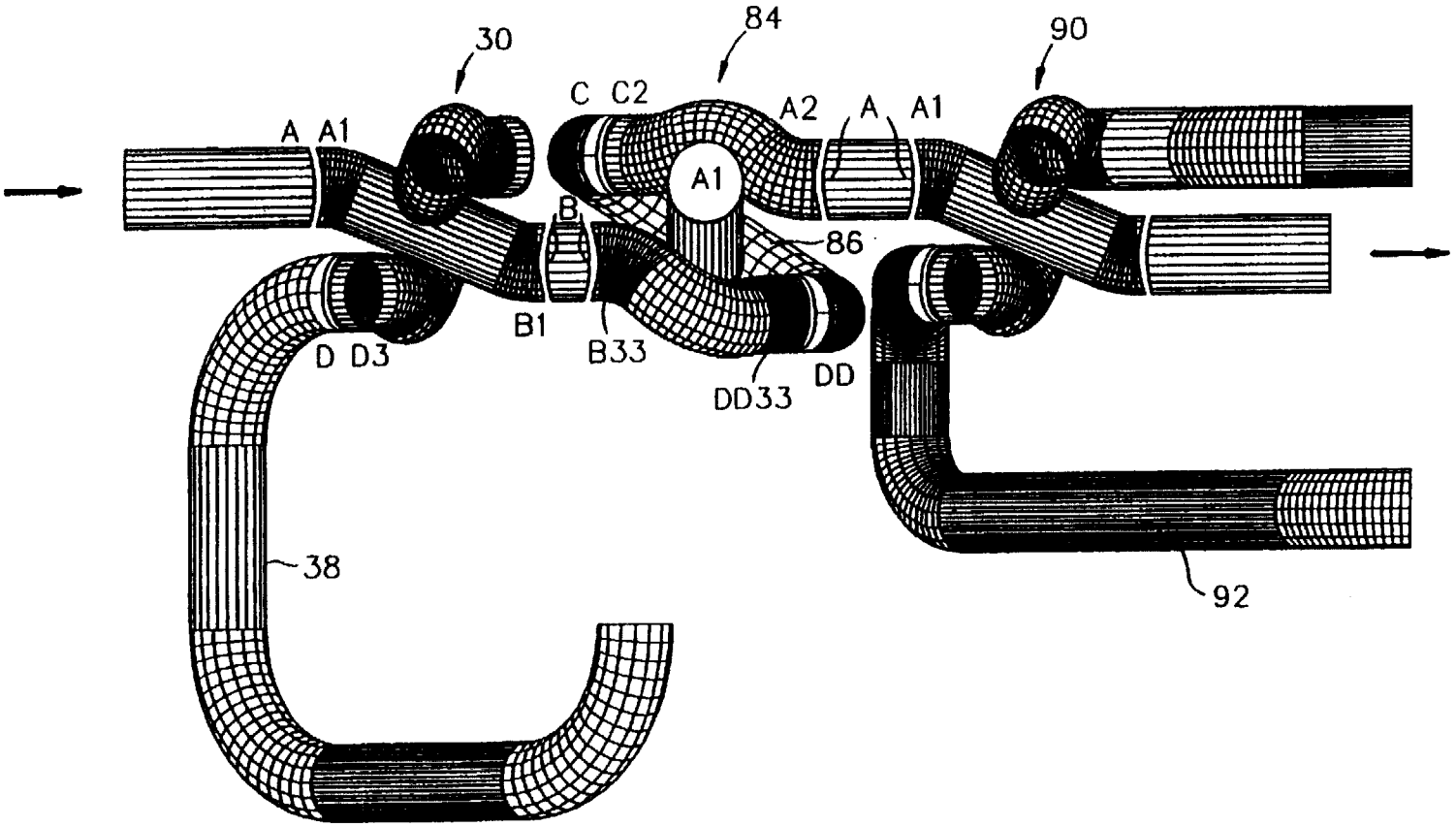
Figure 22:
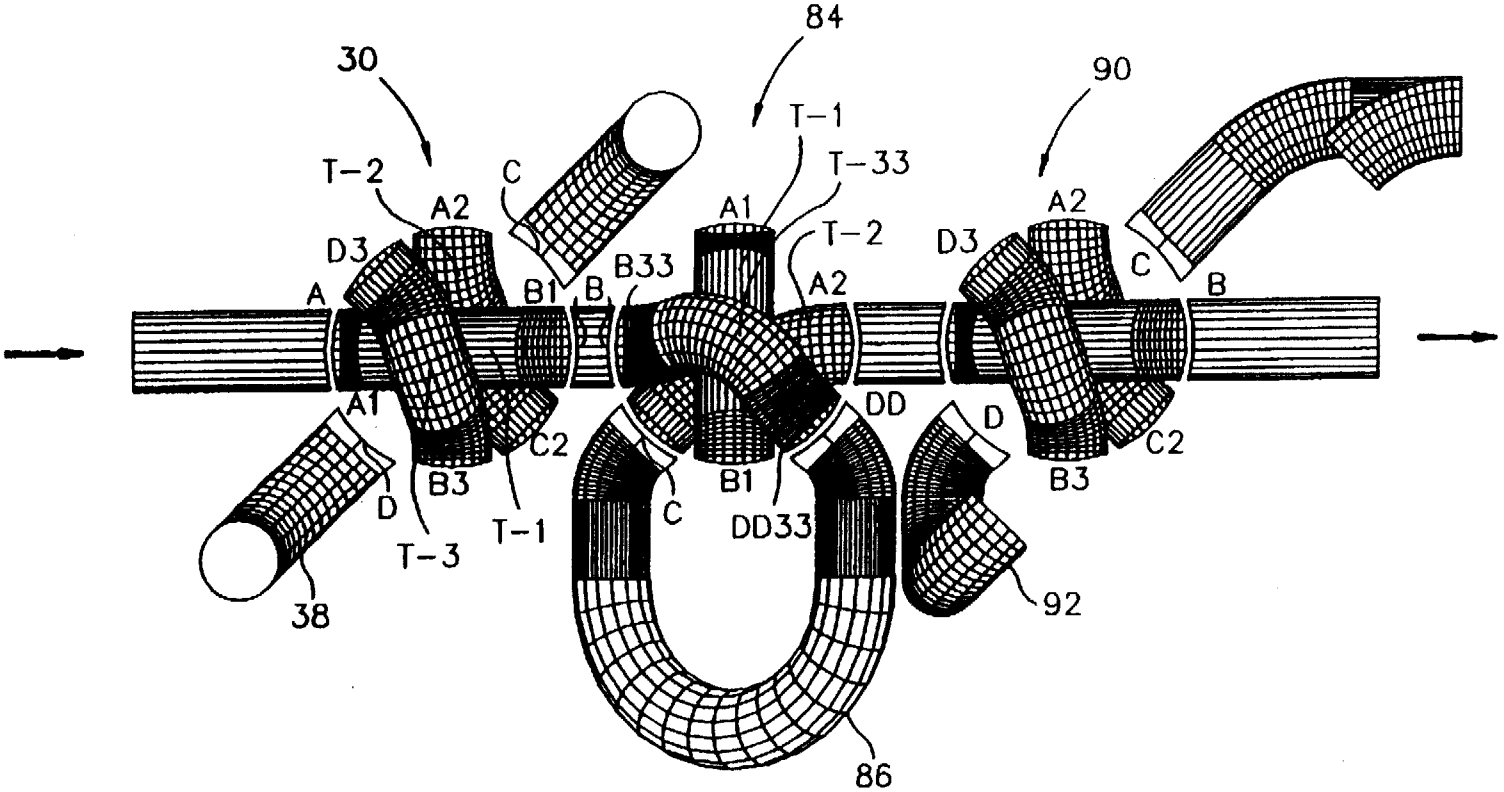
Figure 23:
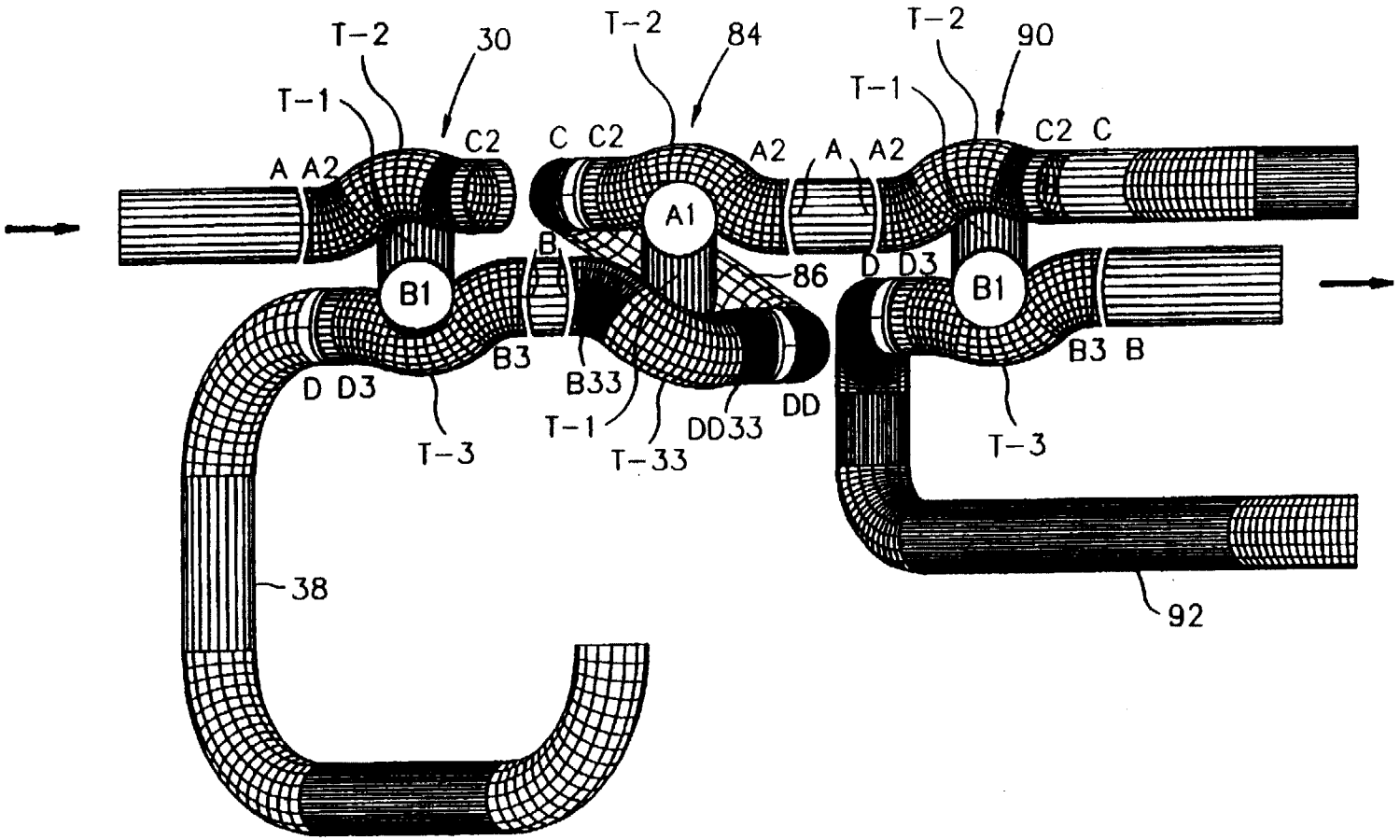
Figure 24:
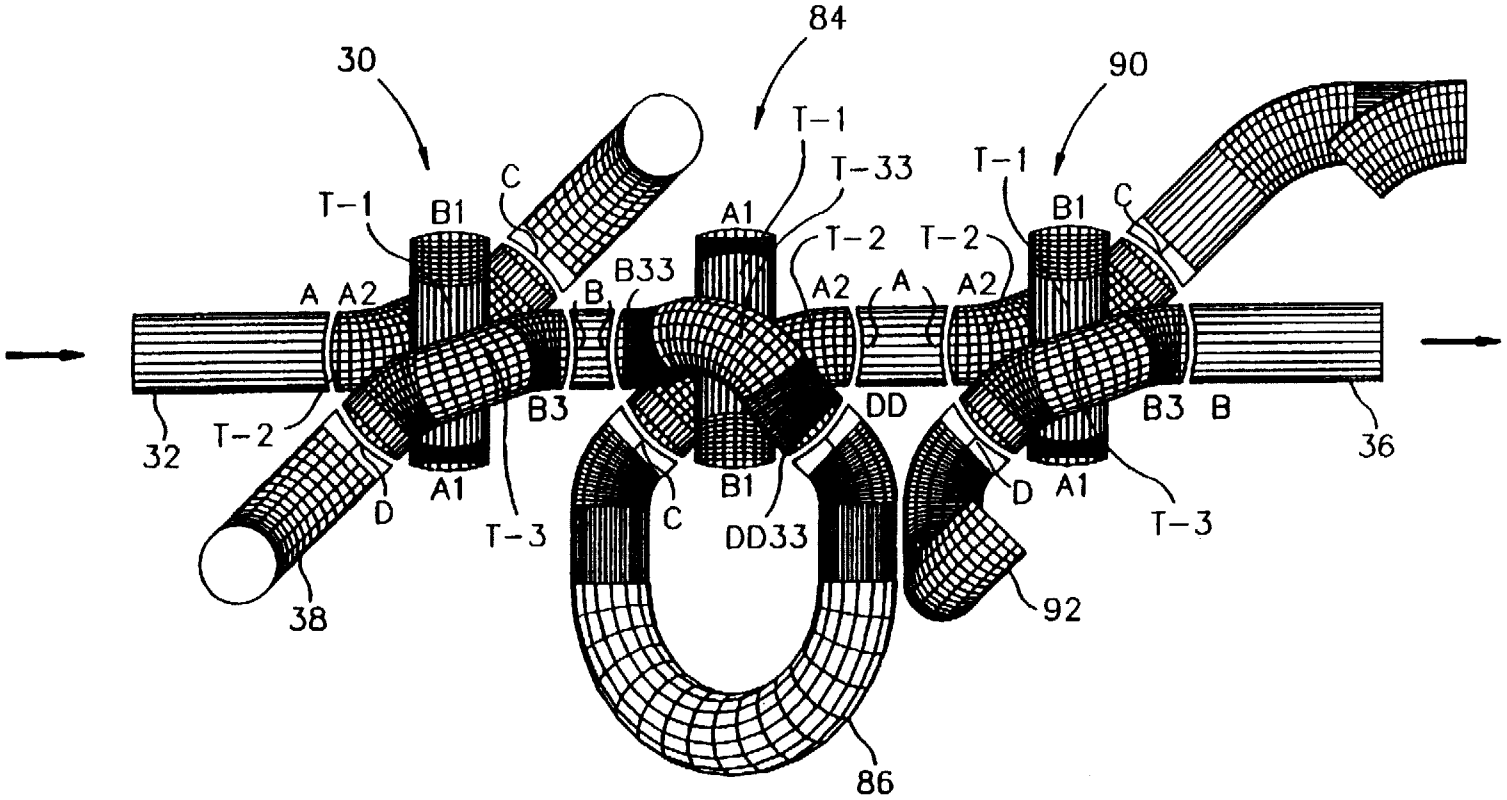
Figure 25:
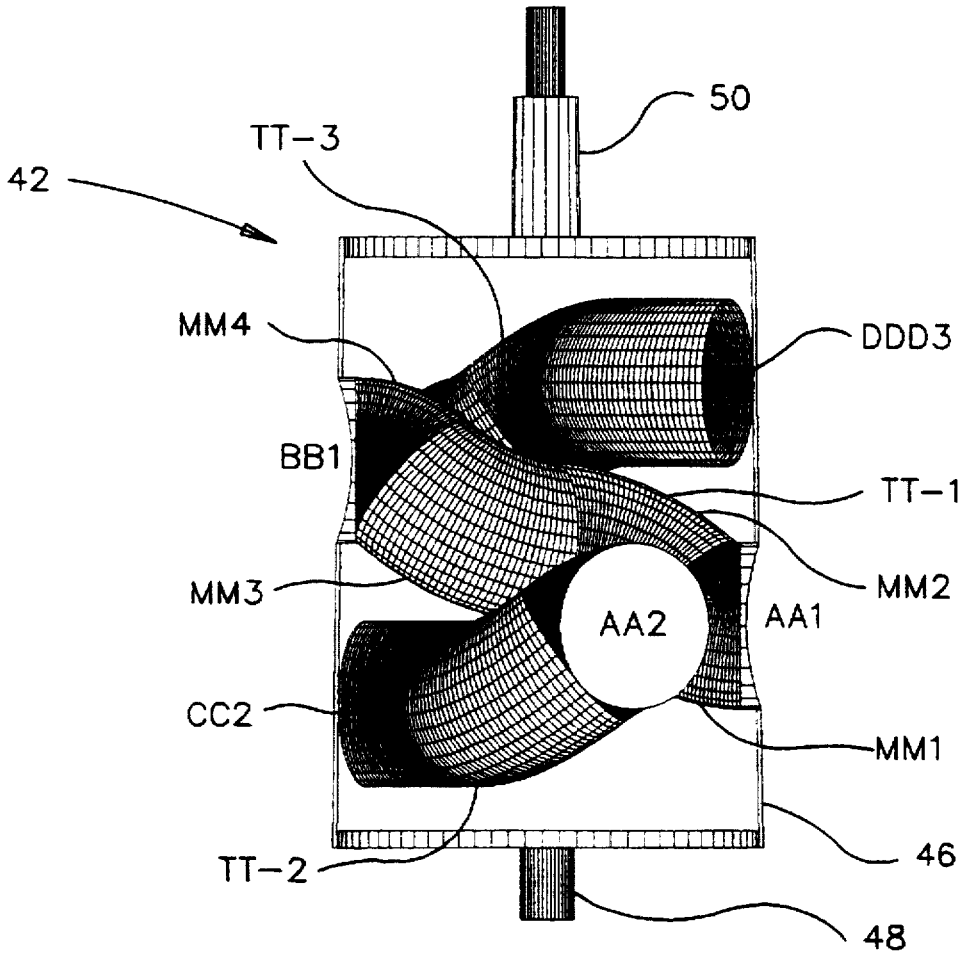
Figure 26:
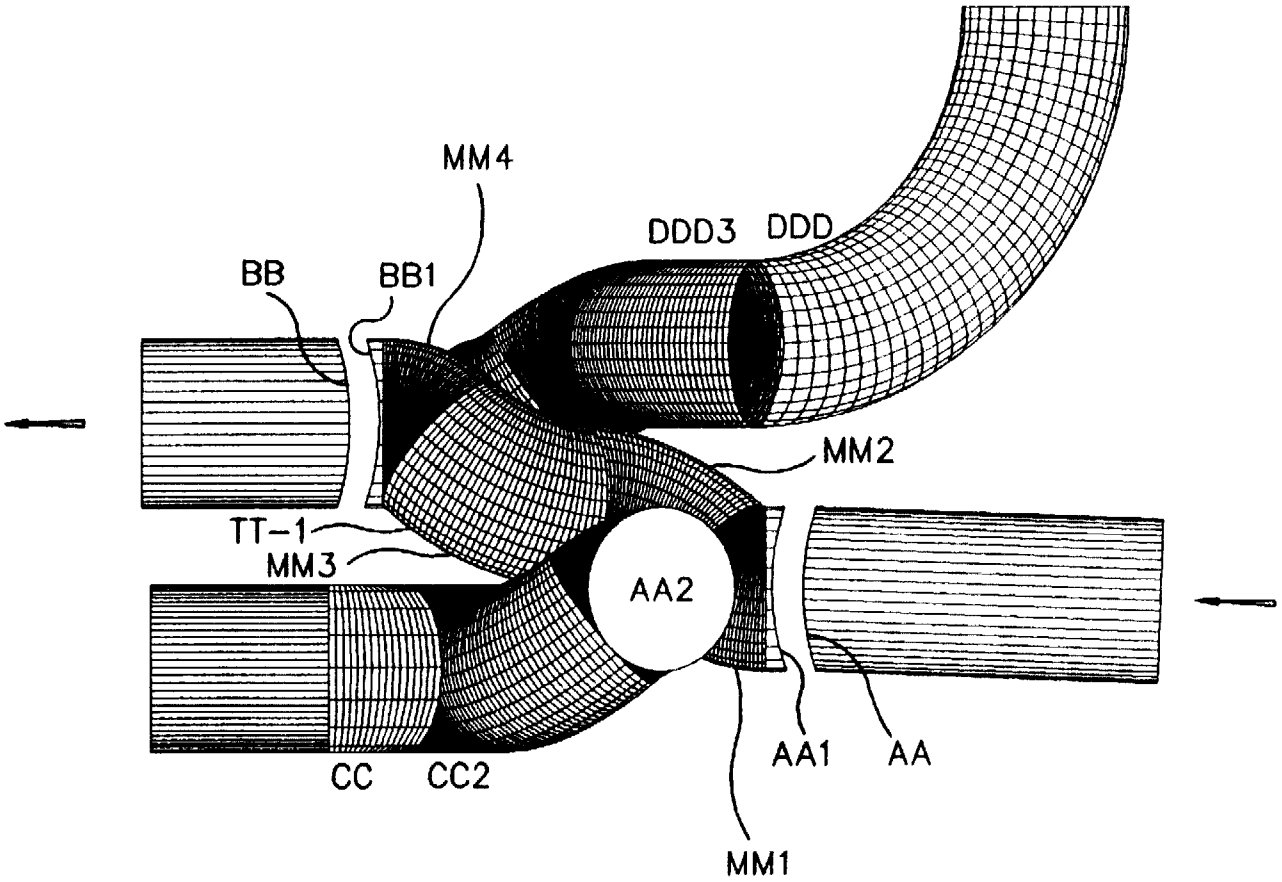
Figure 27:
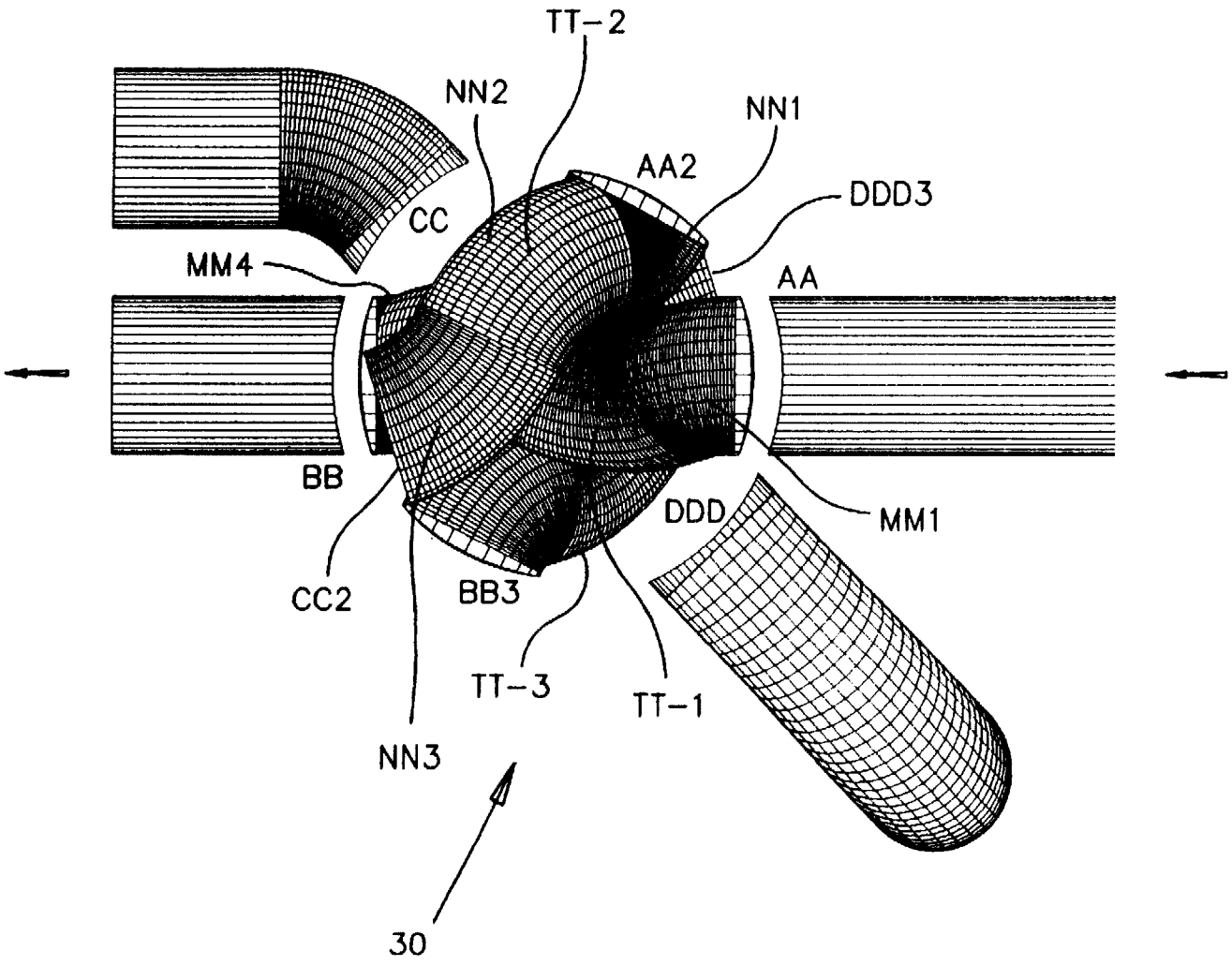
Figure 28:
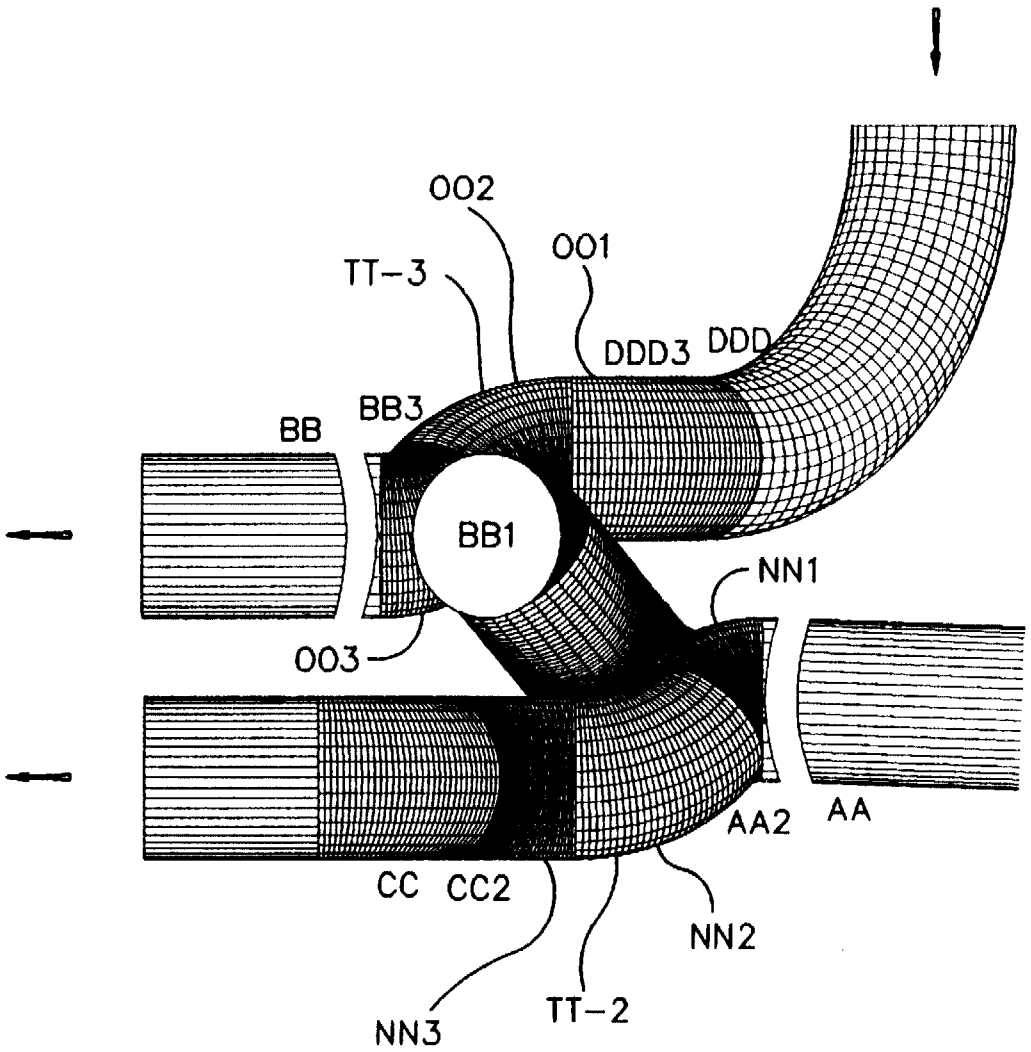
Figure 29:
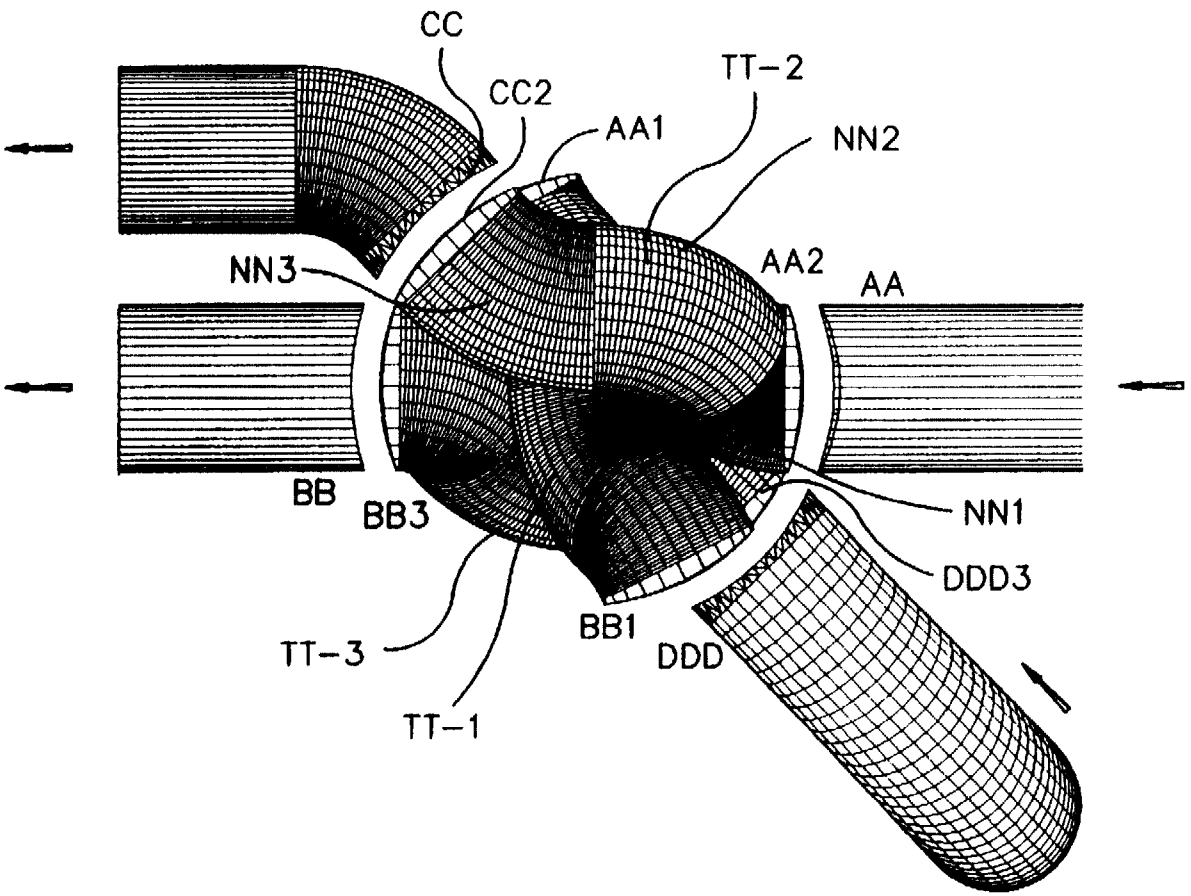

FIG. 16 As a side view similar to FIG. 15;

FIG. 17 is a top pictorial view of the valve combination of FIG. 14;

FIG. 18 is a bottom pictorial view similar to FIG. 17;

FIG. 19 is a top plan view showing the internal passages of the valve combination of FIG. 14 with the valves disengaged;

FIG. 20 is a side view similar to FIG. 19;

FIG. 21 is a top plan view of the valve passages of FIG. 14 with the regular valves disengaged and the intermediate short loop valve engaged;

FIG. 22 is a side view similar to FIG. 21;

FIG. 23 is a top plan view similar to FIG. 19 with all three valves engaged;

FIG. 24 is a side view similar to FIG. 23;

FIG. 25 is a top plan view of a modified valve rotor showing the internal passages;

FIG. 26 is an enlarged top plan view of the rotor of FIG. 25 showing the internal passages of the valve in disengaged position;

FIG. 27 is a left side view similar to FIG. 26;

FIG. 28 is a view similar to FIG. 26 showing the valve in engaged position; and FIG. 29 is a left side view similar to FIG. 28.

DESCRIPTION OF THE INVENTION

The valve of this invention reduces the change in impedance by increasing the radius of the tube bends inside the valve, by providing a uniformly shaped air pathway and by decreasing the gross change in direction of the air pathway as it leaves the valve. In other respects the design of this valve follows the design of the traditional rotary valve and therefore, is easily assembled in multiple valve arrays.

Figure 1:
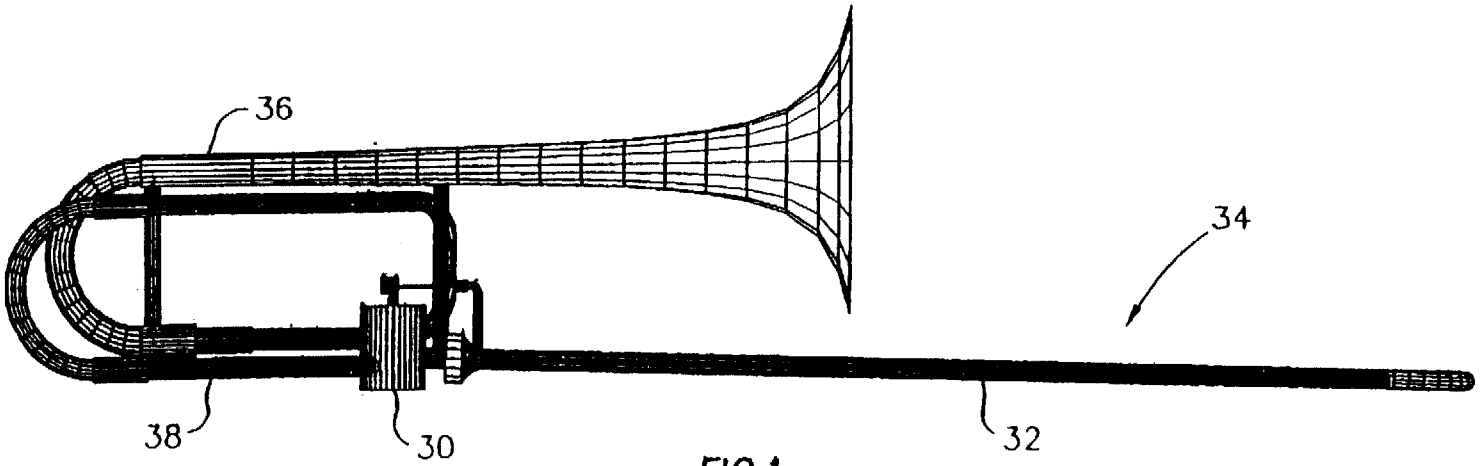
FIG. 1 is a top plan view of the valve on a trombone.
Figure 2:
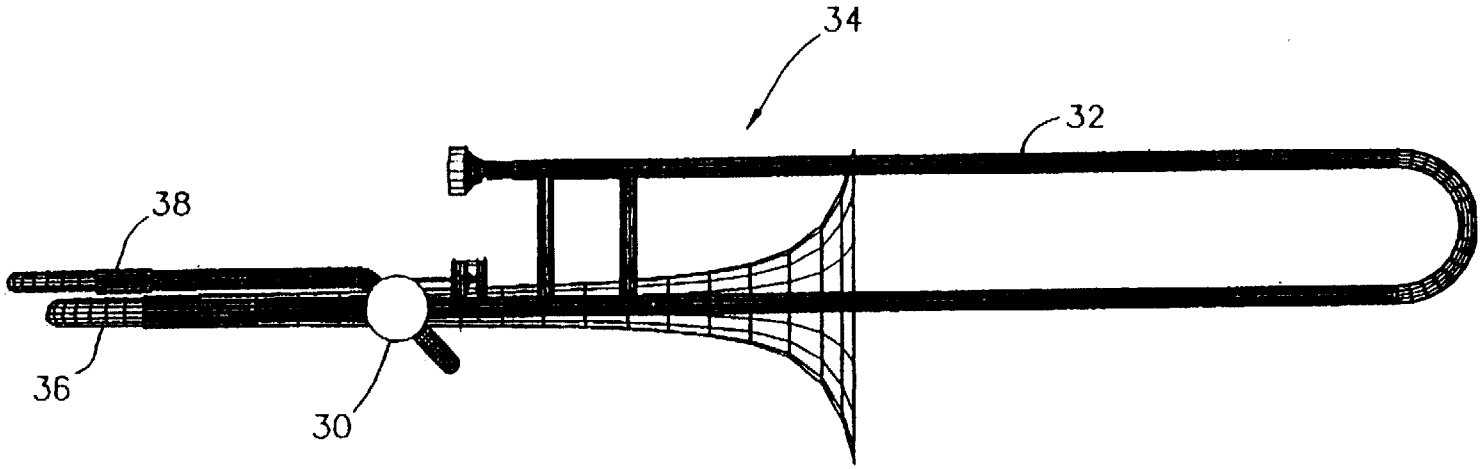
FIG. 2 is a side view taken from the left side of FIG. 1.

As in all brass musical instrument valves, the valve of this invention designated by the reference numeral 30 in FIG. 1 is designed to pass the soundwave from the mouthpiece end 32 of the horn 34 (hereinafter referred to as the "mouthpiece tube") to the bell end 36 of the horn (hereinafter referred to as the "bell tube") when not engaged and from the mouthpiece tube into a tube loop 38 and then out of the tube loop into the bell tube when engaged.

It consists of two hollow cylinders, one situated immediately inside the other. The outer cylinder 40 is called the casing or housing. The inner cylinder 42 is called the rotor. The inside surface 44 of the casing is in very close proximity to the outside surface 46 of the rotor, such that moisture in the air blown through the valve 30 will be sufficient to maintain a seal between the cylinders at air pressure levels produced by a person playing the musical instrument.

Figure 3:
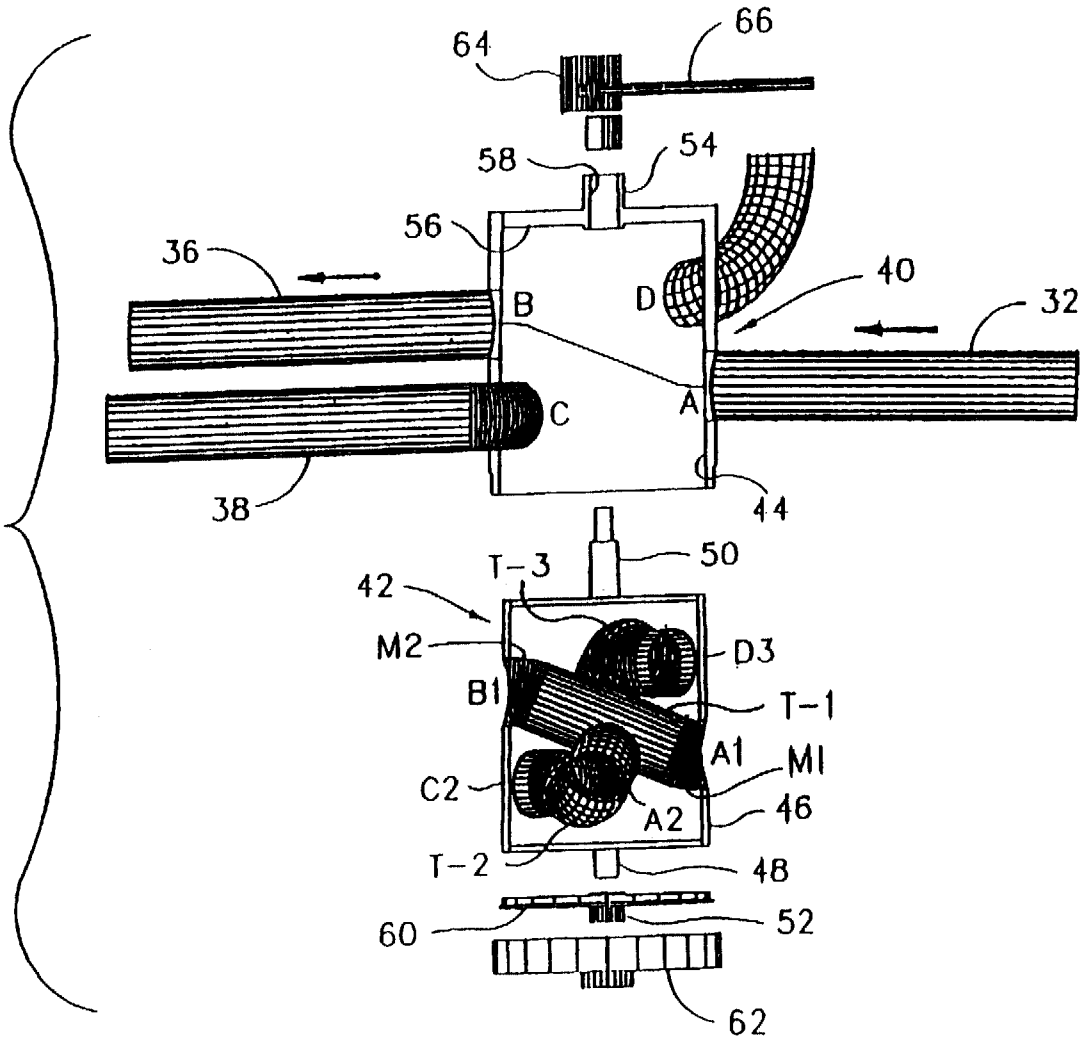
FIG. 3 is an exploded top plan view of the valve with internal passages of the rotor.

As in the traditional rotary valve, the inner surface 44 of the casing and the outer surface 46 of the rotor are held in close proximity to one another, without actual contact, by the operation of two small bearing shafts 48 and 50 at opposite ends of the rotor as shown in FIG. 3 which fit into concomitant bearing bushings 52 and 54 on either end of the casing. The hollow rotor is closed by plugs fixed to both ends with the bearing shafts 48 and 50 mounted on each plug. The casing has a cap 56 permanently fixed to one end in which an elongated bearing hole 58 is machined, creating the bearing bushing 54. The other end of the casing is left open to allow insertion and removal of the rotor. After insertion of the rotor, the open end of the casing is plugged with a plate 60 which is pressed into the end of the casing and which has a bearing hole machined into the center forming the other bearing bushing 52. This plate is then covered with a cap 62 which is screwed onto the open end of the casing to provide a cover for the bearing and the plate. The longitudinal axis of each bearing shaft and bearing hole is identical with the longitudinal axis of both the casing and the rotor. The rotor is rotated by means of an eccentric 64 which attaches to the end of the bearing shaft 50 which projects through the bearing hole of the fixed-cap end. The eccentric is actuated by means of a small spring-controlled lever 66 which is moved by the thumb or finger. Bumpers or stops (not shown) located on the outer surface of the fixed end-cap limit the movement of the eccentric 64 to 90°. In addition to the above bearing shafts, there are (not shown) small bearing surfaces at either end of the rotor on each plug and concomitant bearing surfaces on the fixed-cap and plate ends of the casing. These surfaces are circular, lie in a plane which is defined by a radius of the casing and rotor and limit the amount which the rotor can travel laterally along its longitudinal axis.

In order to provide access through the valve 30 to the mouth piece tube 32, the bell tube 36 and the inlet and outlet of the loop tube 38 four holes, or ports are drilled into the casing. Affixed to these holes are the tube 32 from the mouthpiece, the tube 36 to the bell and the ends of the loop 38 of tubing. Six holes are drilled into the rotor. Three hollow tubes are then affixed so that an end of each tube is attached to the rotor at the place where each hole is located. A tube and two holes providing an inlet and outlet connect to form a continuous internal passage.

All holes in the rotor and casing are circular in cross section as they pass through the cylinder wall and therefore have axes which are identical to radii drawn from the concentric longitudinal axes of the casing and rotor. All tubes in the rotor are continuously circular in cross section, although the tubes do bend to avoid each other. To illustrate, a small ball, such as a marble, having a diameter, close to the internal diameter of the tubes but slightly less, will clear all the passage bends and ports without jamming. All rotor tubing bends have a radius equal to or greater than an outside tube diameter. The rotor has an outside diameter of three times the outside diameter of a tube.

Two of the rotor holes and their concomitant tube align with the mouthpiece tube and bell tube in the casing and pass the soundwave directly from the mouthpiece tube to the bell tube. In this position the valve is not engaged. To engage the valve the rotor is rotated 90° counterclockwise when viewed from the eccentric end as shown.

When engaged, two of the rotor holes and their concomitant tube align with the mouthpiece tube port and the beginning tube loop port in the casing and pass the soundwave from the mouthpiece tube into the loop. The remaining two rotor holes and their concomitant tube align with the ending tube loop and the bell tube port and pass the sound wave out of the loop and into the bell tube.

ORIENTATION

It is assumed for orientation purpose that the valve is looked at along the path of the tube 32 from the mouthpiece. The end of the casing 40 on the right side has the eccentric 64 as shown and the face of the right end can be described as a circle on which the degree of a compass can be assumed with 360°/0° at the top of the circle and with 270° being toward the mouthpiece tube.

LOCATION OF PORTS IN THE CASING

The four ports drilled into the casing will be identified as A, B, C and D. Port A is the port which connects the mouthpiece tube 32 to the casing 40. Port A is located at 270° and its center is somewhat to the left of the center of the distance between the left and right ends of the casing as viewed from the mouthpiece tube 32.

Subsequent port locations will be described by their degree orientation and by a distance removed laterally from Port A along the longitudinal axis of the casing. This distance will be measured in multiples of the outside diameter of the tube located inside the rotor (hereinafter referred to as the "tube diameter").

Port B connects the bell tube 36 to the casing 40. Port B is located at 90° when viewed from the eccentric 64 and its center is about 1 tube diameter to the right of the center of port A. It should be noted FIGS. 2, 5, 7, 9, 11 and 13 view the valve from the left, i.e., the side opposite the eccentric and thus, the compass must be viewed as if looking from the back of the compass.

Port C connects an inlet end of the tube loop 38 to the casing. Port C is located at 45° and its center is located slightly more than ⅓ tube diameter to the left of the center of port A.

Port D connects the outlet end of the tube loop 18 to the casing. Port D is located at 225° and its center is located slightly more than 1 ⅓ tube diameters to the right of the center of Port A.

LOCATION OF HOLES AND TUBES IN THE ROTOR

In the first position there is assumed the orientation as previously stated and that the valve is not engaged and therefore, the rotor has not been rotated 90°. The air passage is directly from the mouthpiece tube 32 through the valve 30 and to the bell tube 36. Three tubes or passages then appear inside the rotor. The tube which communicates between port A and port B will be identified as T-1 with end holes identified as A1 and B1 which are inlet and outlet, respectively. The tube to the left of T-1 will be identified as T-2 with end holes identified as A2 and C2. This tube establishes an inlet passage to loop 38 from the mouthpiece tube 32. The tube to the right of T-1 will be identified as T-3 with end holes identified as D3 and B3 and establishes an outlet passage from the loop 38 to the bell tube 36.

Hole A1 is aligned with port A and like port A, hole A1 is located at 270° and its center is somewhat to the left of the center of the distance between the left and right ends of the rotor.

Subsequent hole locations will be described by their degree orientation with the valve in the disengaged position and by a distance removed laterally from port A along the longitudinal axis of the valve measured in multiples of a tube diameter.

Figure 4:
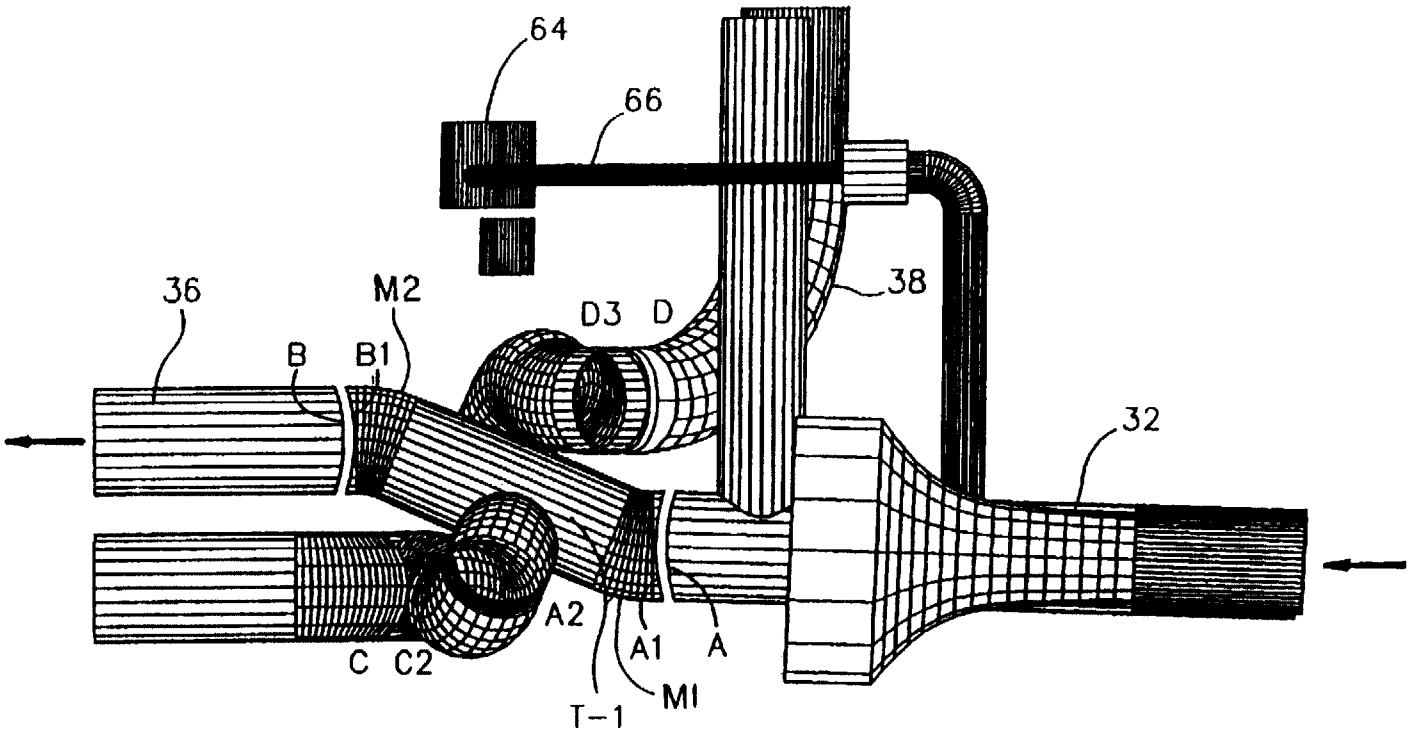
FIG. 4 is an enlarged top plan view showing the internal passages of the valve in disengaged position.
Figure 5:
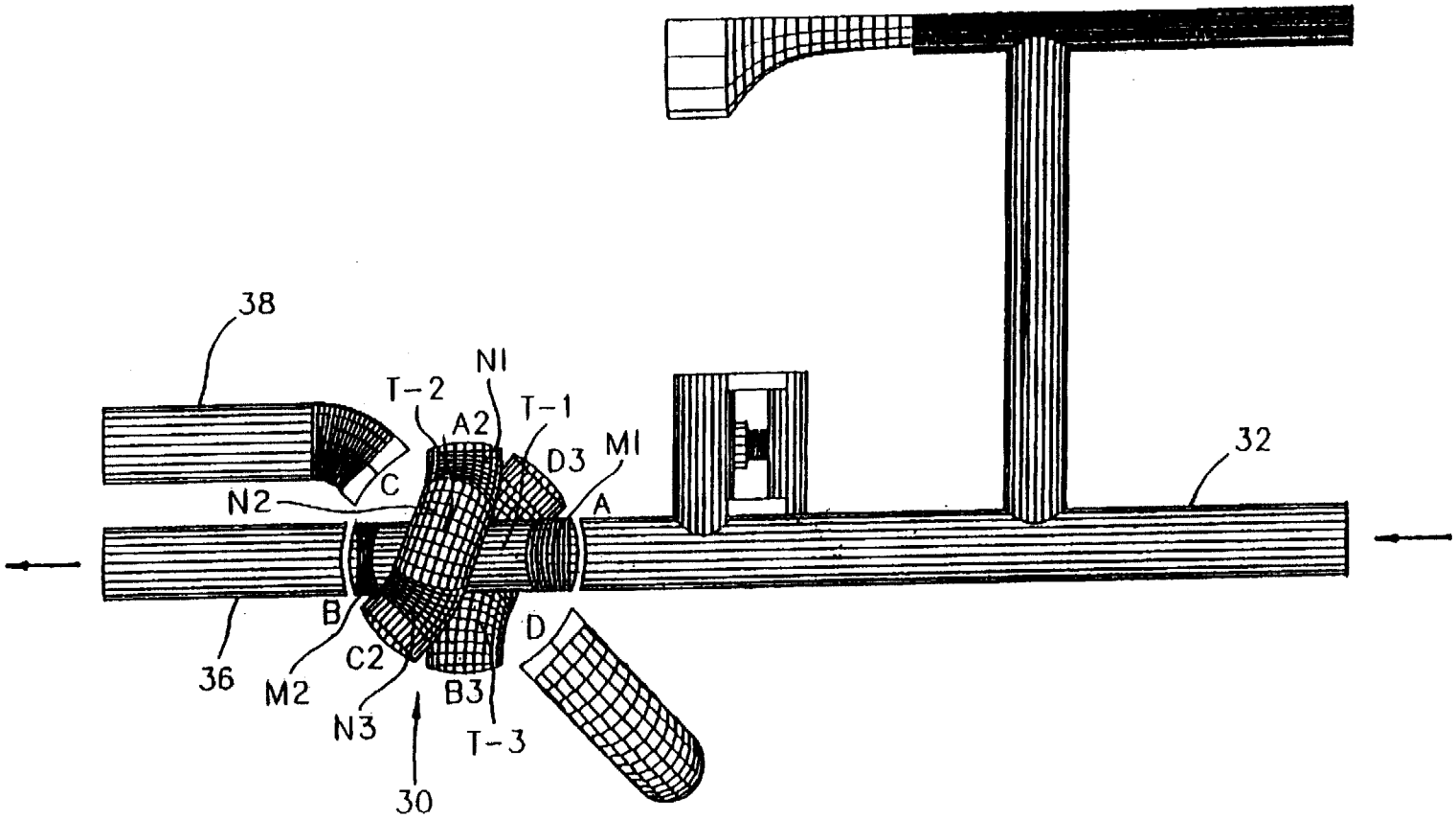
FIG. 5 is a left side view similar to FIG. 4.

Hole B1 is aligned with port B and like port B, hole B1 is located at 90° when viewed at the side from the eccentric and its center is about 1 tube diameter to the right of the center of port A. Tube T-1 ends at hole A1 and hole B1 and provides a continuous passage between the mouth piece and the bell ports A and B. Tube T-1 curves gently to the right with arcs M1 and M2 as shown in FIG. 4 in order to share the necessary deviation with all three tubes so as to allow all tube bends to have a radius equal to or greater than one tube diameter.

Hole A2 is located at 0°. The center of hole A2 is somewhat to the left of the center of the distance between the left and right ends of the valve and its lateral position along the longitudinal axis of the valve is identical with port A.

Hole C2 is located at 135°. The center of hole C2 is located slightly more than ⅓ tube diameter to the left of port A and its lateral position along the longitudinal axis of the valve is identical with port C.

Figure 6:
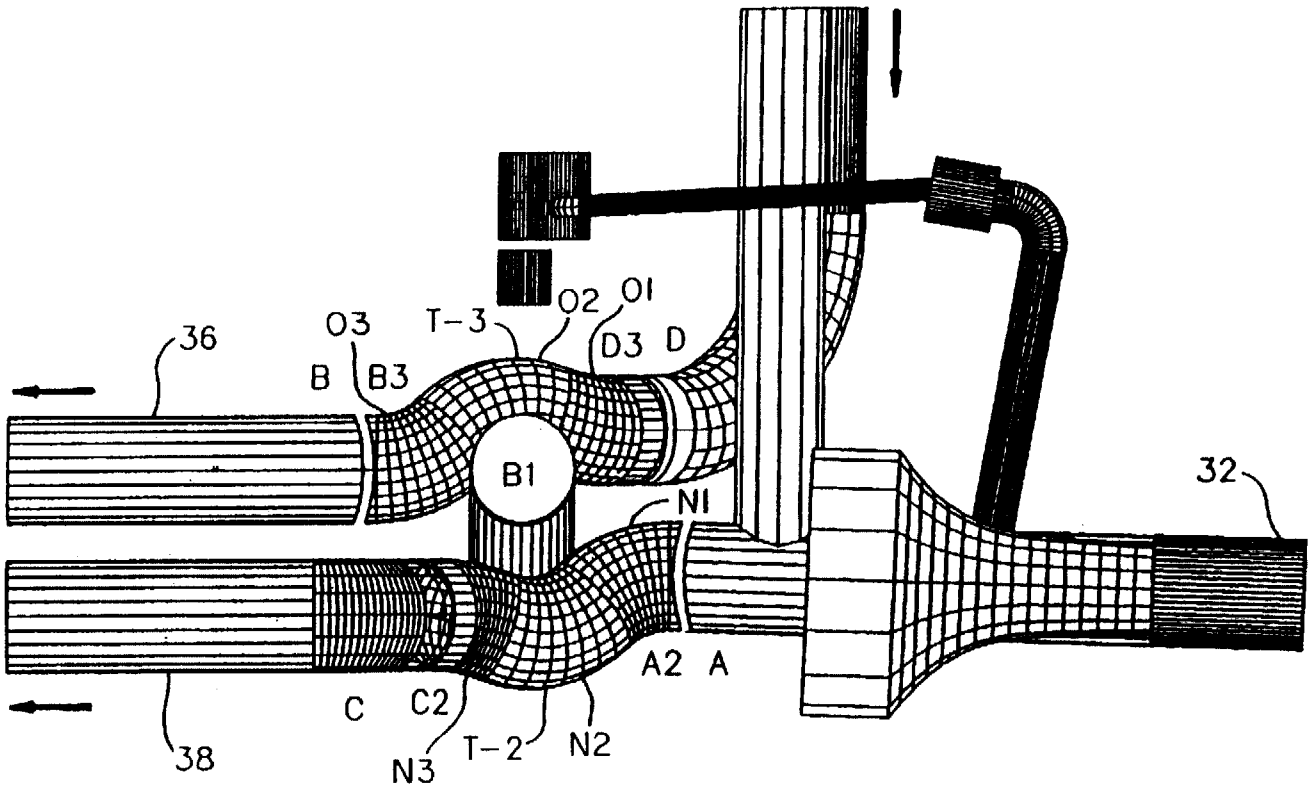
FIG. 6 is a view similar to FIG. 4 showing the valve in engaged position.
Figure 7:
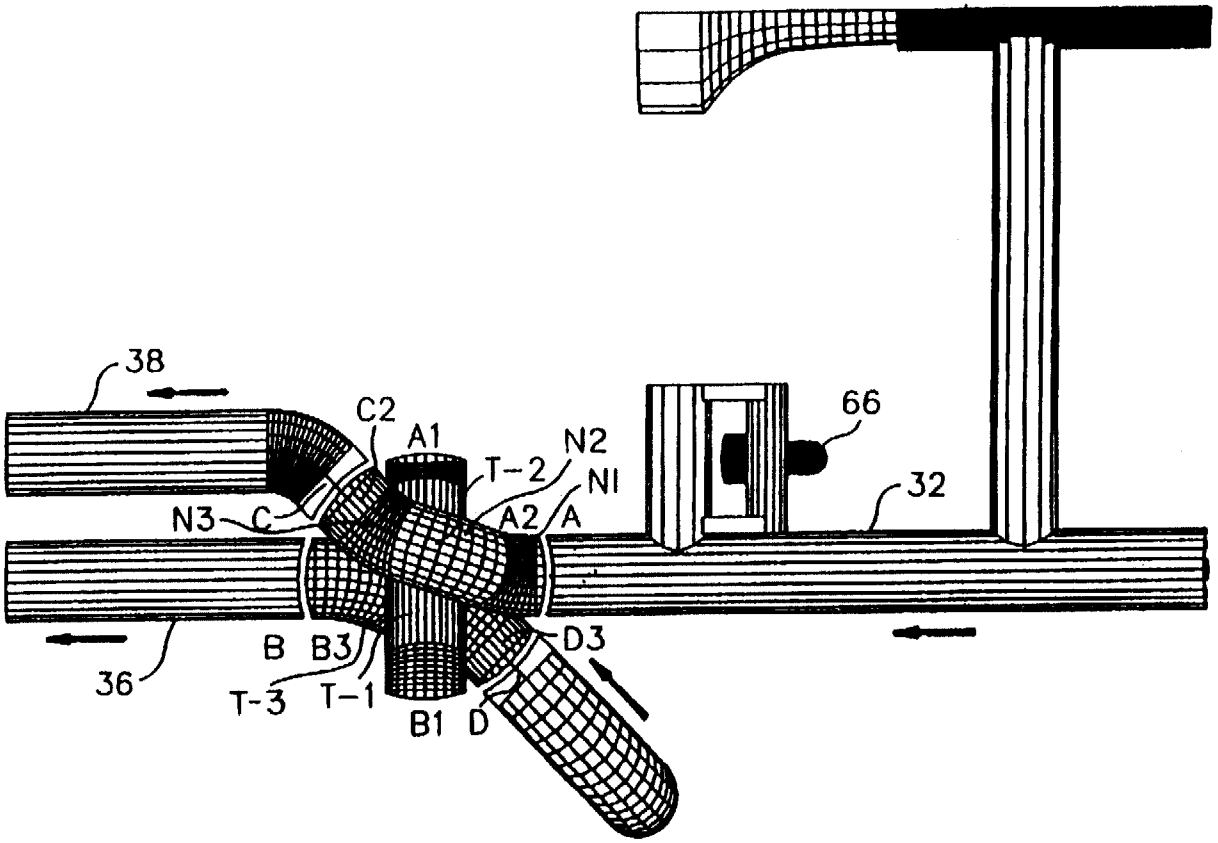
FIG. 7 is a left side view similar to FIG. 6.
Figure 8:
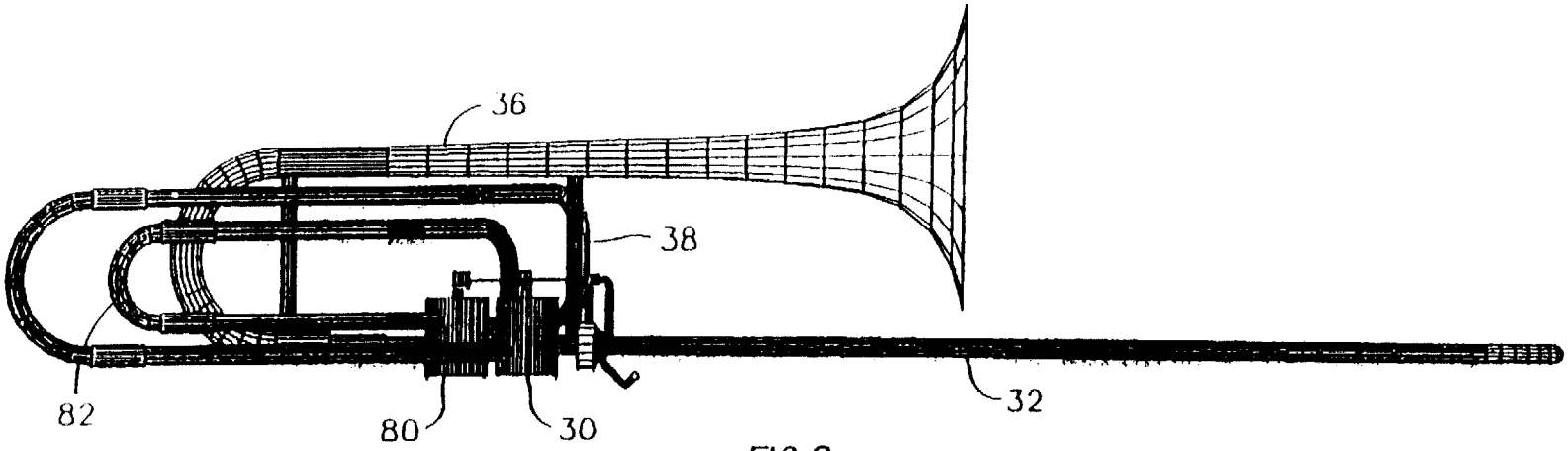
FIG. 8 is a view similar to FIG. 1 showing double or tandem valves with a double loop.
Figure 9:
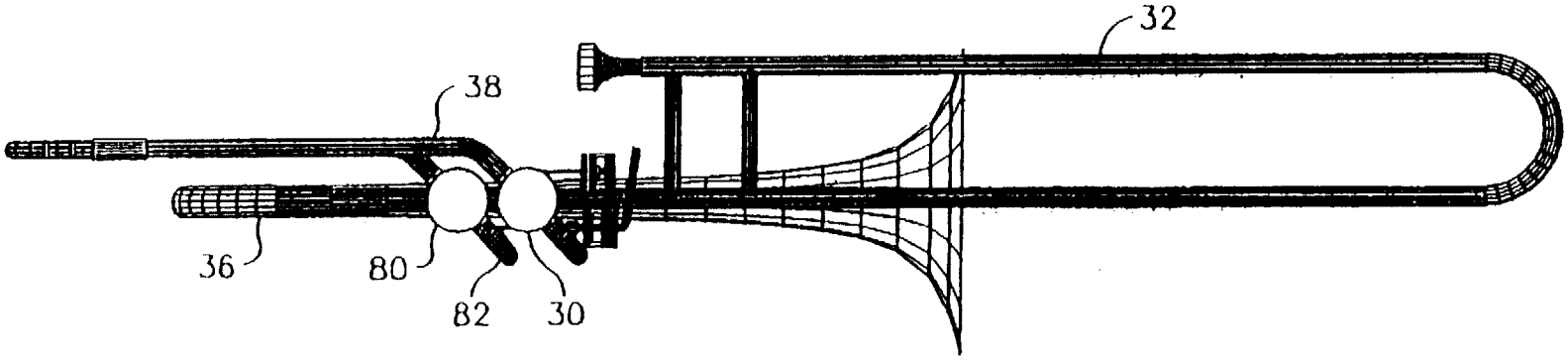
FIG. 9 is a left side view similar to FIG. 8.
Figure 10:
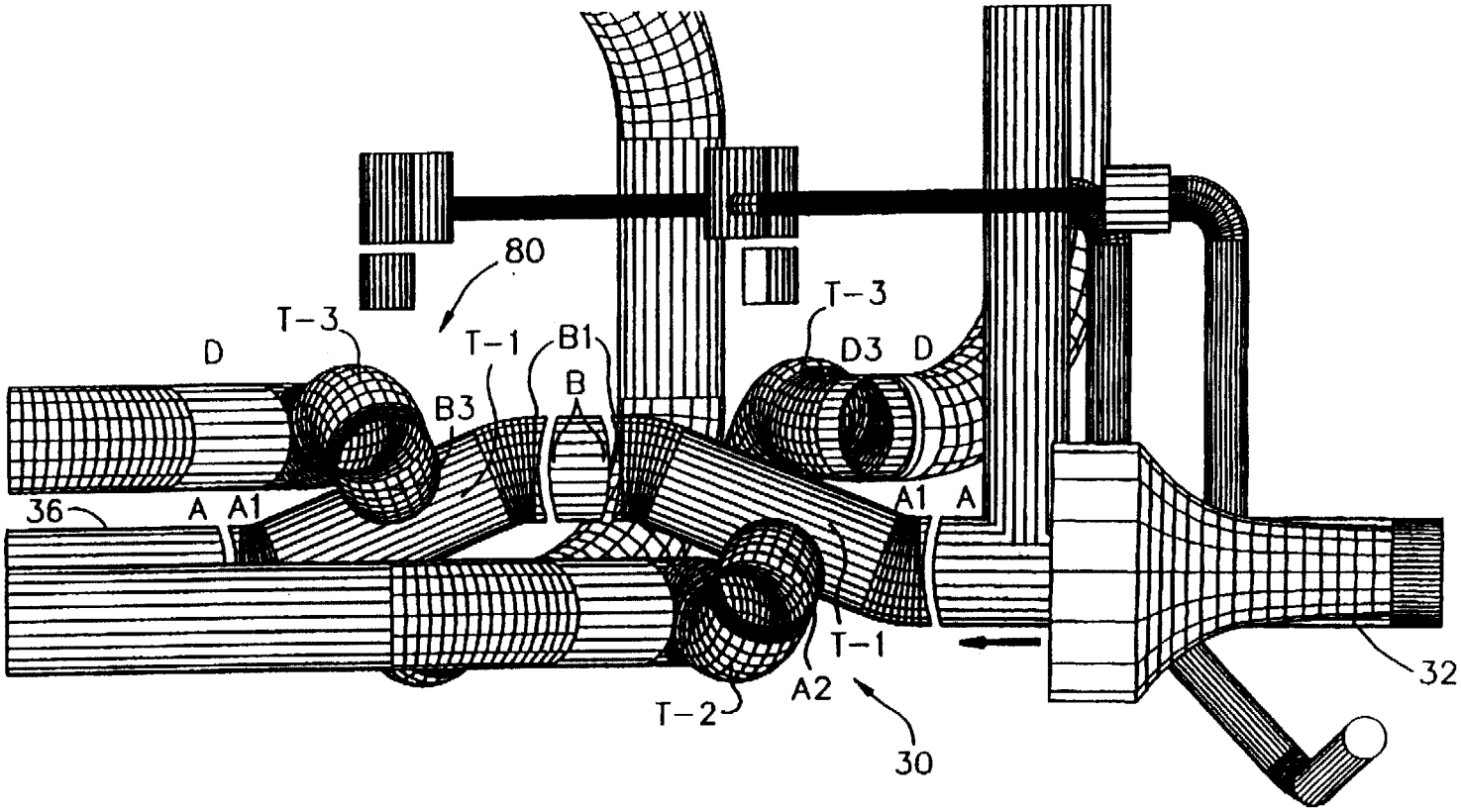
FIG. 10 is an enlarged top plan view showing the internal passages of the double valve in the disengaged position.
Figure 11:
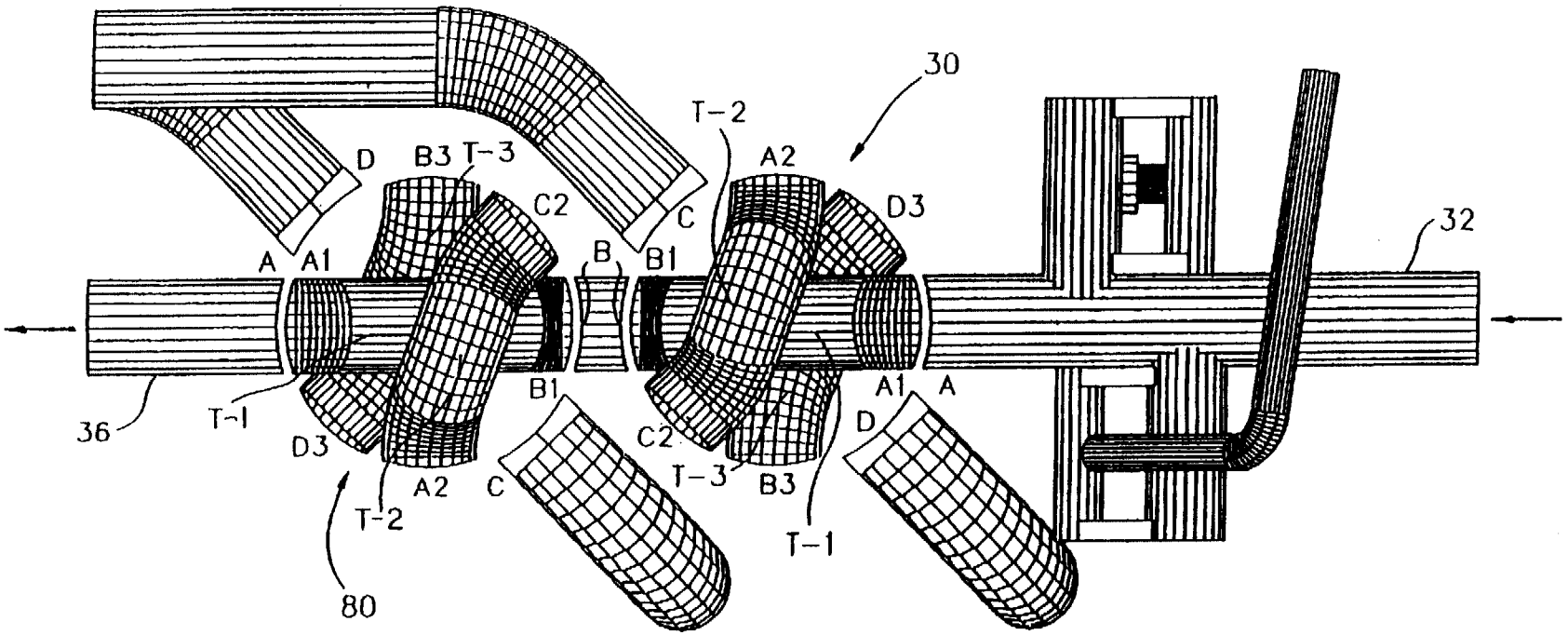
FIG. 11 is a left side view similar to FIG. 10.
Figure 12:
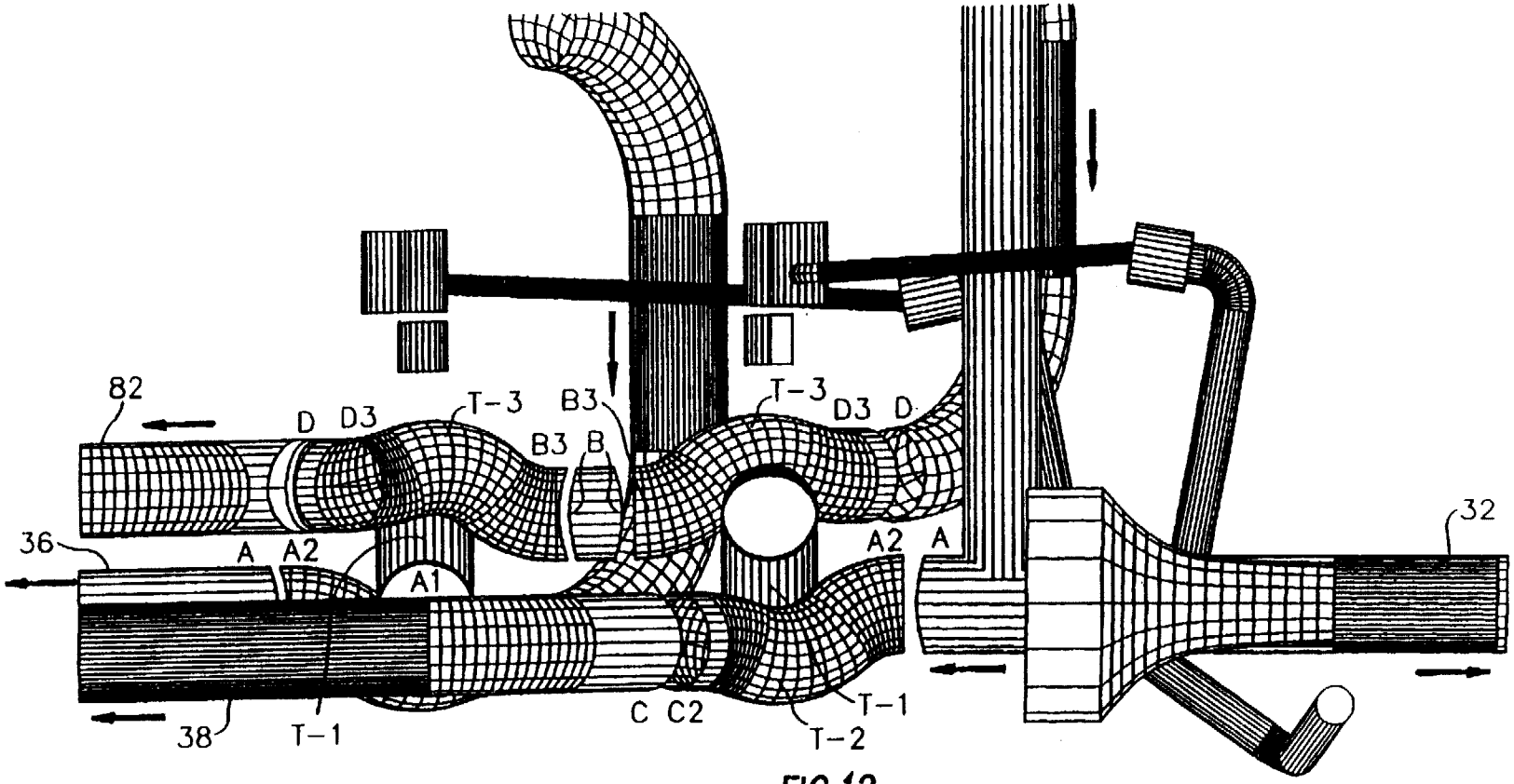
FIG. 12 is a view similar to FIG. 10 showing both valves engaged.
Figure 13:
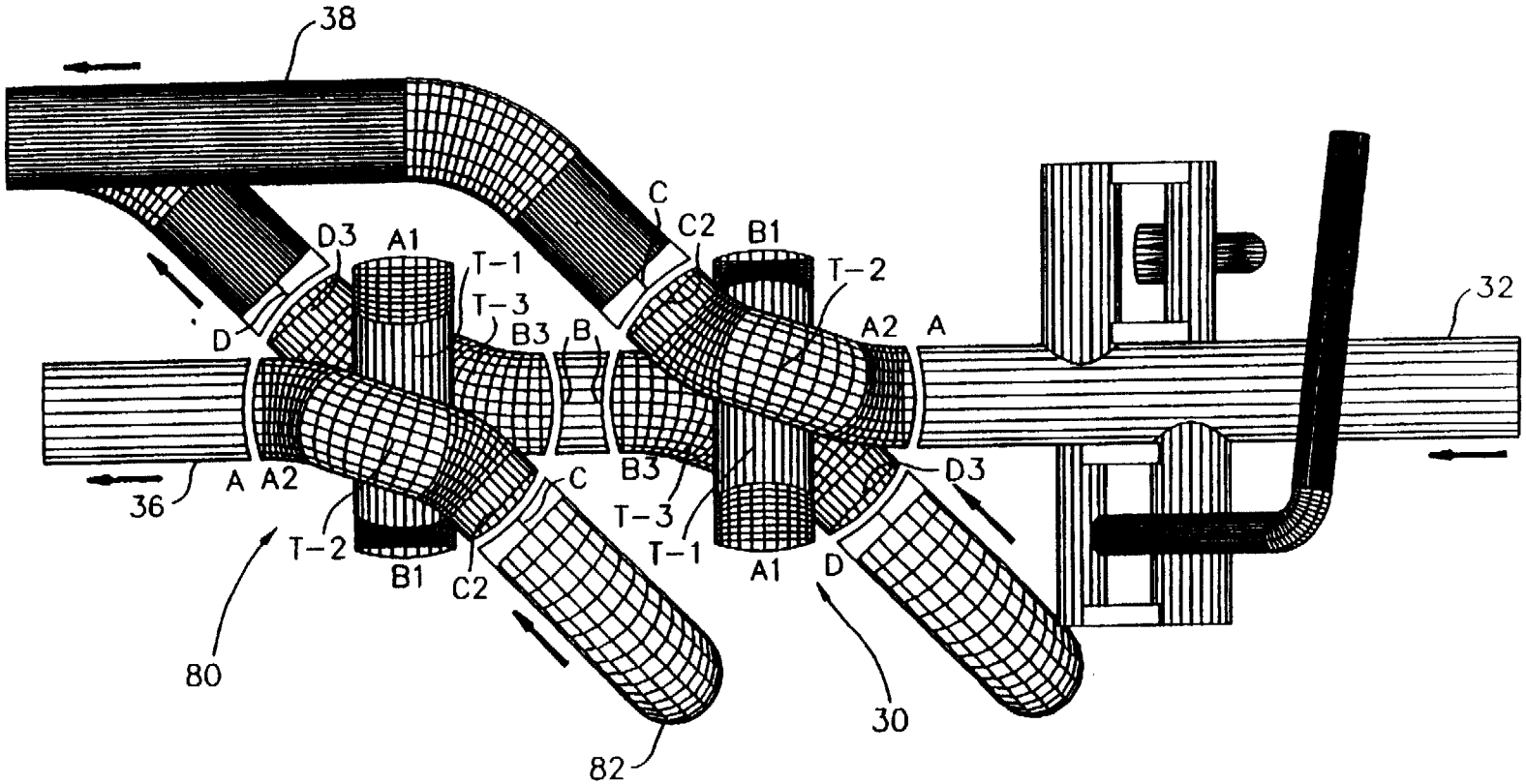
FIG. 13 is a left side view similar to FIG. 12.

T-2 ends at hole A2 and hole C2. Tube T-2 curves gently to the left by way of three arcs N1, N2 and N3 to avoid tube T-1 as shown in FIG. 6. When the valve is engaged as shown in FIG. 7 and the rotor is rotated 90° counterclockwise, hole A2 moves to 270° and hole C2 moves to 45°. Tube T-2 then provides a continuous passage between ports A and C from the mouthpiece tube 32 to the inlet of the loop 38.

Hole B3 is located at 180°. The center of hole B3 is located about 1 tube diameter to the right of port A and the lateral position of hole B3 is identical with port B.

Hole D3 is located at 315°. The center of hole D3 is located slightly more than 1 ⅓ tube diameters to the right of port A and the lateral position of hole D3 is identical with port D. Tube T-3 ends at holes B3 and D3 and provides a passage from the loop 38 outlet to the bell. Tube T-3 curves gently by way of three arcs 01, 02 and 03 to fit around and to avoid tube T-1 as shown in FIG. 6.

Tube T-2 and tube T-3 are identical in shape. When the valve 30 is engaged and the rotor 42 is rotated 90° counterclockwise, hole B3 moves to 90° and hole D3 moves to 225°. Tube T-3 then provides a continuous passage between ports B and D from the outlet of loop 38 to the bell 36. Acting in tandem tubes T-2 and T-3 and loop 38 provide a continuous passage from the mouthpiece tube 32 to bell tube 36.

Thus, as described, this valve provides a soundwave pathway which is continuously circular in cross section, with gentle curves inside the valve and with exit ports which have no more than 45° of deviation from the direction of entry.

MODIFICATION

A modified valve 100 is shown in FIGS. 25 to 29. These FIGS. show the valve and the stages of operation similarly to FIGS. 3–7 for valve 30 and the same reference numerals are used for common parts.

Valve 100 provides for continuous flow through the valve as it is operated from the "straight through" disengaged position to the "loop engaged" position. In general, it is desirable that the distance between the succeeding holes on the rotor, i.e. AA1 to AA2 and BB1 to BB3 be from 30% to 60% of the passage diameter so that some air can pass through the valve during transition. In the example shown in FIGS. 25–29, the distance between holes AA1 and AA2, and BB1 and BB3 is about 42% of the passage diameter.

All rotor tubing bends have a radius equal to or greater than one-half the outside tube diameter. The rotor has an outside diameter of about two and one-half times the outside diameter of a tube. This reduction in diameter decreases the inertia of the rotor which facilitates speed and ease of operation when coupled with rotation of the valve of about 63° as compared with a rotation of about 90° or one-quarter turn in the prior embodiment of valve 30.

ORIENTATION OF VALVE 100

It is assumed for orientation purpose (as in the valve 30) that the valve 100 is looked at along the path of the tube 32 from the mouthpiece. The end of the casing 40 on the right side has the eccentric 64 as shown and the face of the right end can be described as a circle on which the degrees of a compass can be assumed with 360°/0° at the top of the circle and with 270° being toward the mouthpiece tube.

LOCATION OF PORTS IN THE CASING

The four ports drilled into the casing will be identified as AA, BB, CC and DDD. Port AA is the port which connects the mouthpiece tube 32 to the casing 40. Port AA is located at 270° and its center is somewhat to the left of the center of the distance between the left and right ends of the casing as viewed from the mouthpiece tube 32.

Subsequent port locations will be described by their degree orientation and by a distance removed laterally from Port AA along the longitudinal axis of the casing. This distance will be measured in multiples of the outside diameter of the tube located inside the rotor (hereinafter referred to as the "tube diameter").

Port BB connects the bell tube 36 to the casing 40. Port BB is located at 90° when viewed from the eccentric 64 and its center is about 1 tube diameter to the right of the center of port AA. It should be noted FIGS. 27 and 29 view the valve from the left, i.e., the side opposite the eccentric and thus, the compass must be viewed as if looking from the back of the compass.

Port CC connects an inlet end of the tube loop 38 to the casing. Port CC is located at 45° and its center is located slightly less than ½ tube diameter to the left of the center of port AA.

Port DDD connects the outlet end of the tube loop 38 to the casing. Port DDD is located at 225° and its center is located slightly less than 1 ½ tube diameters to the right of the center of Port AA.

LOCATION OF HOLES AND TUBES IN THE ROTOR

In the first position there is assumed the orientation as previously stated and that the valve is not engaged and therefore, the rotor has not been fully rotated 63°. The air passage is directly from the mouthpiece tube 32 through the valve 100 and to the bell tube 36. Three tubes or passages then appear inside the rotor. The tube which communicates between port AA and port BB will be identified as TT-1 with end holes or openings identified as AA1 and BB1 which are inlet and outlet, respectively, as shown in FIG. 25. The tube to the left of TT-1 will be identified as TT-2 with end holes identified as AA2 and CC2 as shown in FIG. 28. This tube establishes an inlet passage to loop 38 from the mouthpiece tube 32. The tube to the right of TT-1 will be identified as TT-3 with end holes identified as DDD3 and BB3 and establishes an outlet passage from the loop 38 to the bell tube 36 likewise shown in FIG. 28.

Hole AA1 is aligned with port AA and like port AA, hole AA1 is located at 270° and its center is somewhat to the left of the center of the distance between the left and right ends of the rotor.

Subsequent hole locations will be described by their degree orientation with the valve in the disengaged position and by a distance removed laterally from port AA along the longitudinal axis of the valve measured in multiples of a tube diameter.

Hole BB1 is aligned with port BB and like port BB, hole BB1 is located at 90° when viewed at the side from the eccentric and its center is about 1 tube diameter to the right of the center of port AA. Tube TT-1 ends at hole AA1 and hole BB1 and provides a continuous passage between the mouth piece and the bell ports AA and BB. Tube TT-1 curves gently to the right with arcs MM1, MM2, MM3 and MM4 as shown in FIG. 26 in order to share the necessary deviation with all three tubes so as to allow all tube bends to have a radius equal to or greater than one-half tube diameter.

Hole AA2 is located at 333°. The center of hole AA2 is somewhat to the left of the center of the distance between the left and right ends of the valve and its lateral position along the longitudinal axis of the valve is identical with port AA.

Hole CC2 is located at 108°. The center of hole CC2 is located slightly less than ½ tube diameter to the left of port AA and its lateral position along the longitudinal axis of the valve is identical with port CC.

TT-2 ends at hole AA2 and hole CC2. Tube TT-2 curves gently to the left by way of three arcs NN1, NN2 and NN3 to fit around and to avoid tube TT-1 as shown in FIG. 28. When the valve is engaged as shown in FIG. 29 and the rotor is rotated 63° counterclockwise as shown in FIG. 28, AA2 moves to 270° and CC2 moves to 45°. Tube TT-2 then provides a continuous passage between ports AA and CC from the mouthpiece tube 32 to the inlet of the loop 38.

Hole BB3 is located at 153°. The center of hole BB3 is located about 1 tube diameter to the right of port AA and the lateral position of hole BB3 is identical with port BB.

Hole DDD3 is located at 288°. The center of hole DDD3 is located slightly less than 1 ½ tube diameters to the right of port AA and the lateral position of hole DDD3 is identical with port DDD. Tube TT-3 ends at holes BB3 and DDD3 and provides a passage from the loop 38 outlet to the bell. Tube TT-3 curves gently by way of three arcs 001, 002 and 003 to fit around and to avoid tube TT-1 as shown in FIG. 28.

Tube TT-2 and tube TT-3 are identical in shape. When the valve 100 is engaged and the rotor 42 is rotated 63° counterclockwise, hole BB3 moves to 90° and hole DDD3 moves to 225°. Tube TT-3 then provides a continuous passage between ports BB and DDD from the outlet of loop 38 to the bell 36. Acting in tandem tubes TT-2 and TT-3 and loop 38 provide a continuous passage from the mouthpiece tube 32 to bell tube 36.

Thus, as described, this valve provides a soundwave pathway which is continuously circular in cross section, with gentle curves inside the valve and with exit ports which have no more than 45° of deviation from the direction of entry.

MULTIPLE VALVE ARRAYS

A second valve 80 can be positioned immediately adjacent to the first valve 30 or the modified valve 100 by rotating the entire valve assembly 180° on the longitudinal axis of the valve. The same reference numerals for the valve, ports holes and tubes will be employed as in valve 30. This valve 80, thus rotated and in the second valve position, has port B of valve 80 directly adjacent to port B of valve 30. In valve 80 port B becomes the entry port from the mouthpiece tube 32 and valve 30, and port A of valve 80 becomes the exit port to the bell tube. In valve 80, the lateral positions of ports A, B, C and D, and holes A1, B1, A-2, C2, B3 and D3, are identical to valve 30 lateral positions. The degree orientation as referred to the original degree orientation of the right end of valve 1 is altered by 180° to the positions noted as follows:

Port A =90°
Port B =270°
Port C =225°
Port D =45°
Hole A1 =90°
Hole B1 =270°
Hole A2 =180°
Hole C2 =315°
Hole B3 =0°
Hole D3 =135°

When the valve is engaged the holes in the rotor move to the following positions:

Hole A2 =90°
Hole C2 =225°
Hole B3 =270°
Hole D3 =45°

With valve 80 thus engaged port D connects to the tube loop 82 at 45° on the right side and port C connects to the loop 82 at 225° on the left side. Since, in valve 30, port C connects to the loop at 45° on the left and port D connects to the loop at 225° on the right, the tube loops on valves 30 and 80 avoid interference with each other and the valves can be placed directly next to one another.

Additional valves can be added to this array by repeating the 180° valve rotation so that valve 30 is in the original position, valve 80 is rotated 180°, a third valve is in the original position and a fourth valve is rotated 180°, etc.

SHORT LOOP VARIATION

In application on some instruments, depending on the relationship between the total length of the instrument and the diameter of the cylindrical tubing, the minimum distance required to situate a loop of tubing between ports C and D may exceed the length of tubing required for a valve. For such applications an altered valve 84 shown in FIGS. 14–18 is designed to allow a shorter tubing loop 86. Although this altered valve can be used as any valve in the array, its description will be in the second, or half-step, valve position as that is the most common application with the first and third valve being valve 30, previously described.

The short loop second valve 84 is identical to valve 80 described above and its orientation in the second valve position, i.e. rotated 180° from the valve 30 position, with the following exceptions:

1. Port D is relocated to port DD at 135° and its lateral position is changed to slightly more than 1 ⅔ tube diameters to the right of port A.

2. Hole D3 is relocated to hole DD33 at 225° and its lateral position is also changed to slightly more than 1 ⅔ tube diameters to the right of port A. When the rotor is rotated 90° counterclockwise, holes DD3 will then align with port DD.

Tube T-3 is reshaped to tube T-33 so that it ends at holes B33 and DD33.

When engaged tube T-33 curves gently to the right to avoid tube T-1 and curves downward to exit at 135°. Tube T-33 then provides a continuous passage between ports B and DD. Tube T-33 is not identical in shape to tube T-2. Each bend in tube T-33 has a radius equal to or greater than one tube diameter. Since port C is at 225° and port DD is at 135°, a shorter tube loop can connect these ports.

Just as multiple valves can be grouped using the original long loop valve 30, so can additional valves be added to the short loop valve using the same principal of rotating the entire valve by 180° for each successive valve. In the application where the short loop valve 84 is the second valve, as in FIGS. 14–18 the third valve 90 has the same orientation as valve 30 and would normally be a long loop valve since the third valve 90 is usually a 1 ½ step valve. Since port DD of short loop valve 84 exits at 135° at slightly more than 1 ⅔ tube diameter to the right of port A and since port D of valve 90 exits at 225° and slightly more than 1 ⅓ tube diameters to the right of port A, there is some interference between the loops of valves 84 and 90 as they approach ports DD and D, respectively. To accommodate this interference, short loop valve 84 and long loop valve 90 are separated slightly and in valve 90, loop 92, as it approaches port D, makes an additional bend to provide clearance.

SHORT LOOP VARIATION FOR VALVE 100

The short loop second valve is identical to valve 84 described above and its orientation in the second valve position, i.e. rotated from 180° from the valve 100 position, with the following exceptions:

1. Port D is relocated to port DD at 135° to 180° and its lateral position is changed to slightly less than 2 tube diameters to the right of port A.

2. Hole D3 is relocated to hole DD33 at 198° to 243° and its lateral position is also changed to slightly less than 2 tube diameters to the right of port A. When the rotor is rotated 63° counterclockwise, hole DD33 will then align with port DD.

Tube T-3 is reshaped to tube T-33 so that it ends at holes B33 and DD33.

When engaged tube T-33 curves gently to the right to avoid tube T-1 and curves downward to exit at 135° to 180°. Tube T-33 then provides a continuous passage between ports B and DD. Tube T-33 is not identical in shape to tube T-2. Each bend in tube T-33 has a radius equal to or greater than one-half tube diameter. Since port C is at 225° and port DD is at 135° to 180°, a shorter tube loop can connect these ports.

Just as multiple valves can be grouped using the original long loop valve 30, so can additional valves be added to the short loop valve using the same principal of rotating the entire valve by 180° for each successive valve. In the application where the short loop valve 84 is the second valve, as in FIGS. 14–18 the third valve 90 has the same orientation as valve 30 and would normally be a long loop valve since the third valve 90 is usually a 1 ½ step valve. Since port DD of short loop valve 84 exits at 135° to 180° at slightly less than 2 tube diameters to the right of port A and since port D of valve 90 exits at 225° and slightly less than 1 ½ tube diameters to the right of port A, there may be some interference between the loops of valves 84 and 90 as they approach ports DD and D, respectively. To accommodate this interference, short loop valve 84 and long loop valve 90 may be separated slightly and in valve 90, loop 92, as it approaches port D, makes an additional bend to provide clearance.

ADDITIONAL SHORT LOOP VARIATIONS

If the short loop valve 90 designed above still requires a tube loop longer than allowed, then two additional designs may be used, but are not illustrated.

By expanding the diameter of the rotor and casing a tubing loop can be contained entirely within the rotor. In this variation ports C and DD and holes C2 and DD33 are eliminated. Tube T-33 is also eliminated. Hole B33 is renamed hole B22 and holes A2 and B22 are connected by tube T-22. In one variation tube T-22 forms a 540° spiral around tube T-1. In the second variation tube T-22 curves to the left to avoid tube T-1. The length of tube T-22 in both variations can be increased by lengthening the rotor and casing along their longitudinal axes and by lengthening tube T-22 outwardly toward the end or ends of the valve. To preserve the design criterion that all tube bends have a radius equal to or greater than a tube diameter for valve 30 or one-half tube diameter for valve 100, the diameter of the valve must be increased.

Various changes and modifications may be made within this invention as will be apparent to those skilled in the art. Such changes and modifications are within the scope and teaching of this invention as defined in the claims appended hereto.

What is claimed is:

1. A rotary valve for a brass musical instrument, said valve having means for controlling air passage directly between a mouth tube and a bell tube in a disengaged position and diverting said air passage into and out of an intermediate loop in an engaged position, said valve comprising a housing and a rotor closely received within said housing, said housing having a plurality of ports comprising a mouthpiece inlet port, a bell tube outlet port, an inlet loop port and an outlet loop port, and said rotor having first, second and third passages, each of said passages having an inlet and outlet opening, each of said passages passing substantially across the axis of and through said rotor, said rotor being moveable to the disengaged position to register said inlet and outlet ports of said housing communicating said mouth tube and bell tube with said first passage and said rotor being moveable to the engaged position to register said inlet port from the mouth tube with said inlet opening to said second passage communicating said second passage outlet opening with said inlet port to said loop and to register said third passage inlet opening communicating with said outlet port from said loop to said third passage outlet opening communicating with said outlet port to the bell tube, said first passage being located between said second and third passages and each of said second and third passages crossing over said first passage on opposite sides of said first passage by means of curvature in said second and third passages.

2. The rotary valve of claim 1 in which said passages are continuously circular in cross section, have a substantially identical diameter and have a radius of curvature within said rotor approximating half the diameter of the passages.

3. The rotary valve of claim 1 in which a second valve identical in construction with said first named valve is positioned in said instrument following closely adjacent to said first valve, said second valve communicating with a second loop, said second valve having substantially identical ports and passages and being rotated substantially 180° on an axis of the second valve from said first valve.

4. The rotary valve of claim 1 in which said second and third passages are curved gently around said first passage and are offset from one another where they cross over the first passage.

5. The rotary valve of claim 1 in which said second and third passages are curved gently around said first passage, and all of said passages have a substantially identical diameter and have a radius of curvature within said rotor approximating half the diameter of the passages.

6. The rotary valve of claim 1 in which said rotor is hollow and in which all of the aforesaid passages are comprised of tubing of substantially the same diameter affixed inside said rotor and in which the rotor member has a circular cross-section and an exterior wall which has an outside diameter closely approximating two and one-half times said tubing diameter.

7. The rotary valve of claim 4 in which the second and third passages are comprised of a plurality of arcs fitting closely around the main rotor passage.

8. The rotary valve of claim 1 in which all the aforesaid passages are comprised of tubing having the same diameter, the second and third passages are comprised of several arcs fitting closely around the main rotor passage, said arcs having radii approximating half the diameter of said passages.

9. The rotary valve of claim 1 in which all the aforesaid passages are comprised of tubing having the same diameter, the second and third passages are comprised of a plurality of arcs fitting closely around the first rotor passage, said first passage having four arcs and each of said second and third passages having three arcs, said arcs having radii approximating half the diameter of said passages and all of the aforesaid passages are comprised of tubing of substantially the same diameter and the rotor member has a circular cross-section and an exterior wall which has a diameter closely approximating two and one-half times said tubing diameter.

10. The rotary valve of claim 1 in which the inlets and outlets of each of said second and third passages do not exceed 45° from one another.

11. The rotary valve of claim 3 in which the second valve is a valve communicating with a second loop which is shorter than the loop communicating with the first valve.

12. The rotary valve of claim 1 in which the second and third passages have substantially the same curvature.

13. The rotary valve of claim 3 in which the second and third passages in both the first and second valves have substantially the same curvature.

14. The rotary valve of claim 11 in which the first and second passages in the first and second valves are substantially the same, respectively, and while the third passage of said second valve is modified to accommodate a shorter loop.

15. The rotary valve of claim 3 in which a third valve is positioned in said instrument following closely adjacent to said second valve and in which said third valve is employed substantially identical with said first valve and has a loop substantially identical with the loop of the first valve, said third valve being rotated on an axis of said third valve 180° with respect to the axis of said second valve.

16. The rotary valve of claim 1 in which all of said passages have circular openings in the rotor and the passages at said openings are perpendicular to an axis of the rotor.

17. The rotary valve of claim 16 in which end openings in all of said passages are diametrically opposed to the ports with which they register.

18. The rotary valve of claim 11 in which the inlets and outlets of each of said second and third passages are approximately 45° from one another.

19. The rotary valve of claim 11 in which all the aforesaid passages are comprised of tubing having the same diameter, the second and third passages are comprised of a plurality of arcs fitting closely around the first rotor passage, said first passage having two arcs and each of said second and third passages having three arcs, said arcs having radii approximating half the diameter of said passage and all of the aforesaid passages are comprised of tubing of substantially the same diameter and the rotor member has a circular cross-section and an exterior wall which has a diameter closely approximating two and one-half times said tubing diameter.

20. The rotary valve of claim 14 in which the inlets and outlets of each said second and third passages are approximately 45° from one another.

21. The rotary valve of claim 1 in which the second and third passages are identical in shape.

22. The rotary valve of claim 6 in which the tubing comprising the second passage is identical in shape to the tubing comprising the third passage.

23. The rotary valve of claim 1 in which means are provided for a continuous flow through the first, second and third passages as the valve is operated from a completely disengaged position to a completely engaged position.

24. The rotary valve of claim 23 in which the distance between the succeeding passages of the mouth piece inlet port and the inlet port to the loop is between 30% to 60% of the diameter of a passage as the valve is operated.

25. The rotary valve of claim 23 in which said distance between succeeding passages is about 42% of the diameter of a passage.

26. The rotary valve of claim 23 in which all of said passages have a substantially identical diameter and have a radius of curvature within said rotor about half the diameter of the passages.

27. The rotary valve of claim 23 in which all the passages have a circular cross-section of substantially the same diameter and the rotor member has an outside diameter approximately two and one-half times the passage diameter.

28. The rotary valve of claim 23 in which said rotor is moveable about 63° from the disengaged position to the engaged position.

* * * * *

UNITED STATES PATENT AND TRADEMARK OFFICE

CERTIFICATE OF CORRECTION

PATENT NO. : 5,798,471

DATED : August 25, 1998

INVENTOR(S) : Robert M. Miller

It is certified that error appears in the above-identified patent and that said Letters Patent is hereby corrected as shown below:

Column 12, line 21, "two" should read ----four---- .

Signed and Sealed this

Twenty-third Day of February, 1999

*Attest:*

Q. TODD DICKINSON

*Attesting Officer*

*Acting Commissioner of Patents and Trademarks*